US012612917B1

(12) United States Patent
Mansir et al.

(10) Patent No.: US 12,612,917 B1
(45) Date of Patent: Apr. 28, 2026

(54) SAFETY CONTROLS FOR ELECTRICAL SUBMERSIBLE PUMP SYSTEMS

(71) Applicant: Halliburton Energy Services, Inc., Houston, TX (US)

(72) Inventors: Hassan Mansir, Frimley (GB); John Badawi, Frimley (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/932,156

(22) Filed: Oct. 30, 2024

(51) Int. Cl.

| | |
|---|---|
| ***F04D 15/00*** | (2006.01) |
| ***E21B 33/038*** | (2006.01) |
| ***E21B 43/12*** | (2006.01) |
| ***E21B 47/12*** | (2012.01) |
| ***F04D 13/10*** | (2006.01) |
| ***F04D 15/02*** | (2006.01) |
| ***F04D 25/06*** | (2006.01) |
| ***F04D 27/02*** | (2006.01) |

(52) U.S. Cl.
CPC ..... *F04D 15/0077* (2013.01); *E21B 43/128* (2013.01); *F04D 13/10* (2013.01); *E21B 33/0385* (2013.01); *E21B 47/12* (2013.01); *F04D 15/0083* (2013.01); *F04D 15/02* (2013.01); *F04D 15/0236* (2013.01); *F04D 25/06* (2013.01); *F04D 27/02* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,703,387 | A | 10/1987 | Miller | |
| 4,798,247 | A * | 1/1989 | Deaton | E21B 34/16 251/129.2 |
| 10,718,200 | B2 * | 7/2020 | Coste | F04D 13/10 |
| 12,057,796 | B2 | 8/2024 | Li et al. | |
| 2017/0194784 | A1 * | 7/2017 | Alaas | G01R 31/52 |
| 2017/0331280 | A1 | 11/2017 | Koenecke et al. | |
| 2018/0298738 | A1 * | 10/2018 | Mujica | E21B 47/008 |
| 2021/0025381 | A1 * | 1/2021 | Orfanoudakis | E21B 43/128 |
| 2022/0393461 | A1 | 12/2022 | Pihl et al. | |

(Continued)

FOREIGN PATENT DOCUMENTS

CN 212935521 4/2021

OTHER PUBLICATIONS

"Electric and Hybrid Vehicles", Hse Health and Safety Executive; https://www.hse.gov.uk/mvr/topics/electric-hybrid.htm; Date obtained from the internet: Nov. 5, 2024, 9 pages.

(Continued)

*Primary Examiner* — Binh Q Tran
(74) *Attorney, Agent, or Firm* — DeLizio, Peacock, Lewin and Guerra, LLP

(57) ABSTRACT

Safety control apparatus for limiting voltages on electrical conductors included in a motor power cable that are connected to a motor of an electrical submersible pump assembly are described. The safety control apparatus include circuitry, which when electrically coupled to the electrical conductors of the motor power cable, is configured to controllably connect and disconnect the electrical conductors to and from, respectively, a motor load element, to provide a braking function limiting the motor rotational speed, and thereby limit the voltage level that the rotation of the motor may induce onto the electrical conductors.

20 Claims, 10 Drawing Sheets

(56) References Cited

U.S. PATENT DOCUMENTS

| | | | | |
|---|---|---|---|---|
| 2023/0076519 | A1* | 3/2023 | Henderson | E21B 43/128 |
| 2023/0231505 | A1* | 7/2023 | Li | H02P 3/22 318/445 |
| 2024/0110569 | A1* | 4/2024 | Hicks | F04D 29/007 |

OTHER PUBLICATIONS

Brinner, et al., "Induction Versus Permanent-Magnet Motors for Electric Submersible Pump Field and Laboratory Comparisons", IEEE Transactions on Industry Applications, vol. 50, No. 1, Jan./Feb. 2014, pp. 174-181.

Harris, et al., "Leveraging ESP Energy Efficiency with Permanent Magnet Motors", Paper presented at the SPE Electric Submersible Pump Symposium, The Woodlands, Texas, USA, Apr. 2017, 16 pages.

Huhtanen, et al., "Safety Aspects of Permanent Magnet Motors in Paper Machine Applications", Conference Record of 2004 Annual Pulp and Paper Industry Technical Conference (IEEE Cat. No.04CH37523), Victoria, BC, Canada, 2004, pp. 45-48.

"PCT Application No. PCT/US2024/056441 International Search Report and Written Opinion", Jul. 18, 2025, 11 pages.

* cited by examiner

SAFETY CONTROLS FOR ELECTRICAL SUBMERSIBLE PUMP SYSTEMS

TECHNICAL FIELD

The present disclosure relates generally to wellbore systems, and, more particularly, to various embodiments of safety controls for electrical submersible pumps for use in wellbore systems.

BACKGROUND

An artificial lift, such as an electric submersible pump (ESP), can be positioned in a wellbore of a geological formation for hydrocarbon recovery. Such a pump system can be positioned in the wellbore to facilitate extraction of fluids from within the geological formation and up to the surface of the wellbore. Examples of such fluids can be hydrocarbons, water, etc. Such ESPs can be efficient and reliable artificial-lift methods for pumping moderate to high volumes of fluids.

BRIEF DESCRIPTION OF THE DRAWINGS

Embodiments of the disclosure may be better understood by referencing the accompanying drawings.

Figure 1A:
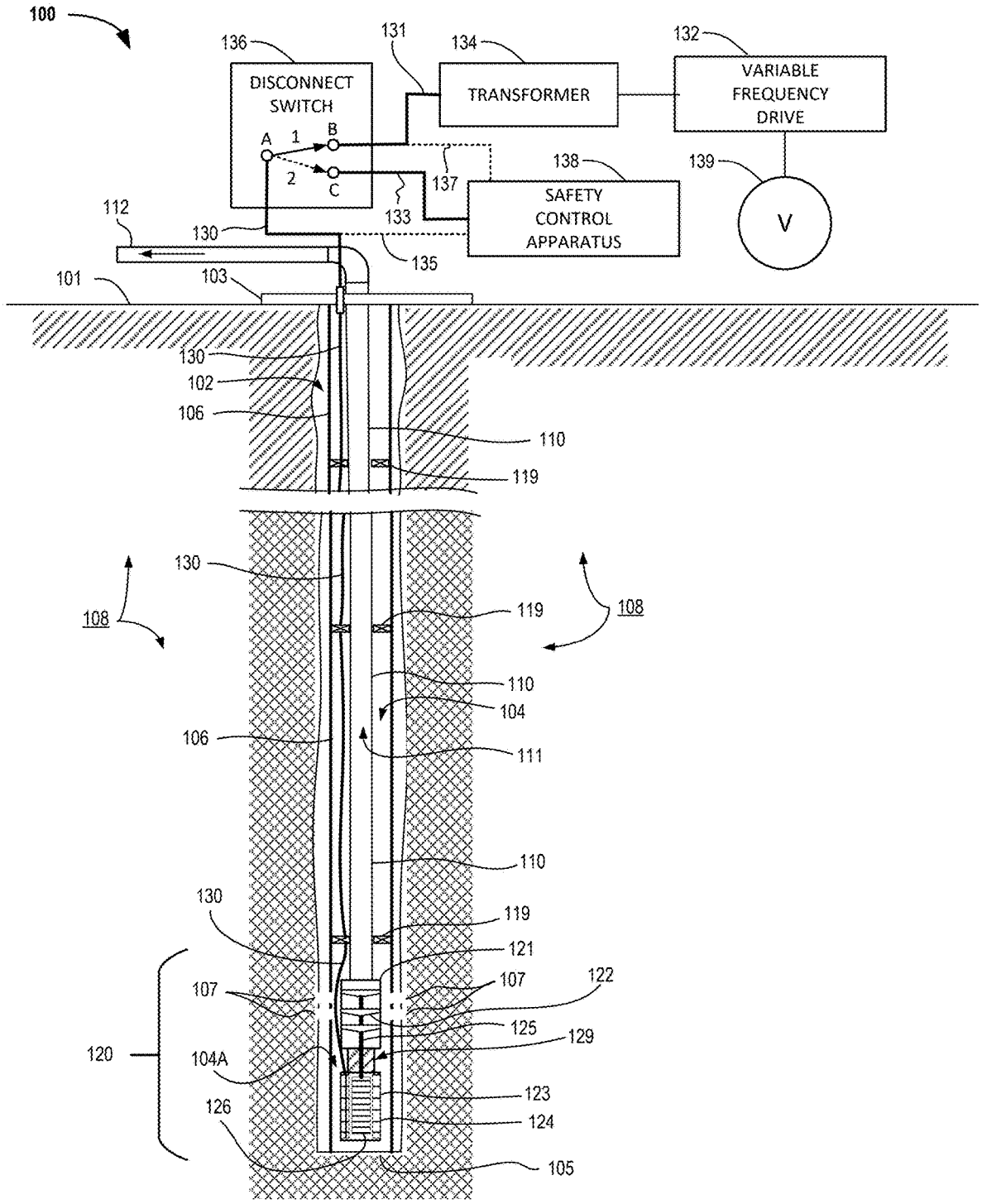
FIG. 1A illustrates a diagram of a wellbore system including a safety control apparatus coupled to an electrical submersible pump assembly, in accordance with various embodiments.

The drawings are provided for the purpose of illustrating example embodiments. The scope of the claims and of the disclosure are not necessarily limited to the systems, apparatus, methods, or techniques, or any arrangements thereof, as illustrated in these figures. In the drawings and description that follow, like parts are typically marked throughout the specification and drawings with the same or coordinated reference numerals. The drawing figures are not necessarily to scale. Certain features of the invention may be shown to be exaggerated in scale or in somewhat schematic form, and some details of conventional elements may not be shown in the interest of clarity and conciseness.

DETAILED DESCRIPTION

The description that follows includes example systems, methods, techniques, and program flows that embody aspects of the disclosure. The description includes example embodiments of control systems, apparatus, methods, and techniques configured to provide safety features associated with electrical submersible pumps being installed, withdrawn from, and/or during various stages of deployment in a wellbore system.

Permanent magnet motor (PMM) technology has started to occupy a leading position in aerospace and a number of industrial sectors thanks to their constant torque characteristics, higher efficiencies, and compactness when compared to the traditional induction motor technology. The trend for using PMMs in the oil and gas sector has started in electrical submersible pumps (ESPs) in Russia more than a decade ago but has only recently started in western oil and gas operations. Now PMMs are accepted and deployed by a number of western operators. The major characteristic of a PMM is the presence of the rotor field without electric current being supplied to its windings. In practice, this means that the motor winding generates an electromotive force (EMF) every time the motor is rotated either connected or not to the variable speed drive system. This EMF can be lethal if service personnel are not aware of its presence and if the conditions for it to be present are not mitigated.

An ESP can be driven and the motor rotated unpowered during deployment, retrieval and soon after shutdown when the fluid in the column flows back to the formation. Therefore, the potential safety issues to service personnel are real and need to be actively mitigated. The primary method of mitigating EMF risk is to prevent rotation of the pump (turbine) and motor by preventing the movement of well fluid through the pump. Mechanical devices such as sliding sleeves, wire line set plugs, fluid diverter valves etc. are common completion items. While this problem is primarily aimed at PMMs it is also known for standard induction motors to have partial magnetization remaining in their rotor and can cause generation of back-EMF voltages during backspin. Another aspect of backspin is that uncontrolled backspin can cause damage to the ESP string if the ESP string spins too fast and damage pump elements not designed to run at speeds higher than their normal operating speeds and/or in the wrong direction for lengths of time.

The proposed solutions include use of a brake chopper safety control apparatus operating at the surface and connected to the free end of the cable in the cable reel, or connected at the junction box to the cable, in order to maintain the voltage generated by the motor coupled at the distal end of the cable to a safe level. Apparatus and methods as described herein may be referred to as a "brake chopper" in that a pulse-width-modulated signal is generated and used to controllably connect and disconnect a motor of an ESP assembly to and from, respectively, a motor load while the motor is not being powered for operation, the motor load being controllably connected and disconnected to the motor during times when the motor is being rotated due to a flow of fluid through the ESP assembly, such as during a backspin event, or during installation, repositioning, and/or removal of the ESP assembly at a wellbore site. This unintentional rotation of the motor may result in a voltage level, which may be dangerous to personnel and/or to equipment, to be induced onto the conductors of the motor power cable that is electrically coupled to the motor. The unintentional rotation of the motor itself may result in an undesirable level of rotational speed and/or direction of rotation that may be harmful to the motor itself. The output voltage present on the cable is rectified and fed to a motor load element, such as a resistor or a bank of resistors, and/or an electrical energy storage device such as a battery or one or more capacitors, through a brake chopper circuit to control the output voltage to maintaining it below the safe level, in some embodiments a level of 50 Volts DC maximum. Embodiments of the brake chopper circuit may also be configured to limit the unintended rotational speed of the motor while also maintaining some maximum voltage level that the motor is inducing into the electrical conductors of the motor power cable that are coupled to the motor and that are configured to carry the electrical current used to power the motor through the motor power cable.

Embodiments of the brake chopper safety control apparatus will include providing sound and/or light indications every time the brake chopper circuit is activated to apply a motor braking load to the conductors of the cable, or is coupled to the cable but is in a standby mode comprising not presently applying a motor braking load to the electrical conductors of the cable but monitoring the voltage level present on these electrical conductors.

When the Variable Frequency Drive (VFD) coupled to the motor power cable and the motor shuts down, the safety control apparatus receives signals indicative of the measured voltage output, and in turn, the brake chopper is utilized to apply a motor load in a pulse width modulated manner in order to maintain the voltage levels present on the cable within a safe level. Embodiments include a mobile unit that may be transported by the field team and deployed every time there is an intervention. Embodiments include a universal unit configured to deal with all ESP sizes or units sized for the class of applications. The main functions of the brake chopper include:

- To maximize energy absorption of that generated by the back spinning ESP (PMM) into a resistor bank to act as brake to limit the speed the ESP will reach and reduce the time in backspin.
- To control the voltage generated by the output of the rectifier to always be below a predetermined "safe" voltage level, for example 50 volts.

In operation, the brake chopper is configured to limit the speed of the ESP during a backspin event and absorb the potential energy in the fluid in a controlled way. By limiting the speed and absorbing the potential energy in the fluid column, the voltages present on the conductors of the motor power cable may be limited to safe level while reducing the duration of the event. In various embodiments, the brake chopper will use a power electronic switch (e.g. an insulated-gate bipolar transistor (IGBT)), to switch the output of a three phase rectifier into a motor load, such as a resistor or a resistor bank. In various embodiments, the brake chopper will vary the switching duty cycle of the power electronic switch in order to maximise the power draw by the resistor bank, and thereby achieve the target parameters including minimizing back spin speed and limiting terminal voltage levels.

Simulation models have been shown to provide solutions which can limit backspin speed. Other simulation models show resistors can be selected to maximise terminal voltage (e.g. 50 volts), or maximise power delivered to load (reduces back spin speed and time).

Embodiments may include the use of the output filter components (specifically) the resistors as the motor load for the brake chopper. Embodiments may include having a load (resistive/capacitive) that can be increased in banks (increase/decrease load) as required.

Embodiments may include having the resistor load on the DC bus that is provided as an output from a rectifier of the safety control apparatus, and using the IGBTs of the variable frequency drive (VFD), which are configured to drive the motor of the ESP during normal operation of the ESP, to boost the voltage of the DC bus, and then switch in the resistor load once the DC bus is above a "normal" or predetermined safe voltage level threshold.

Embodiments may include use of the VFD having an active front end to export the power to the local grid and/or local energy storage that can be used for the next start-up.

It would be understood that embodiments of this disclosure may be practiced without all of the specific details as described herein. Further, while the wellbores as illustrated and described in the figures of this disclosure are shown as comprising a vertically oriented borehole and/or as a vertically oriented borehole coupled to a horizontally oriented borehole, embodiments of wellbores where the systems and methods as described in this disclosure may be deployed are not limited to wellbores having any particular orientation, and may include vertical, horizontal, and/or inclined wellbores, and combinations of these, including wellbore systems including one or more branches coupled to a main, a secondary, or other network(s) of a wellbore.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as limited to denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water, such as an ocean, or a body of fresh water.

Throughout this disclosure the terms "proximal" and "distal" are used to refer to a particular end portion of a device or element, such as a cable, a tubing, a casing, or a borehole, which extend for some distance in a colinear or parallel direction relative to a longitudinal axis of the wellbore. The term "proximal" or "proximal end" refers to the end portion of the device or element that is closest to the wellhead of a wellbore when measured along the longitudinal axis of the wellbore and regardless of the actual distance from the wellhead. The term "distal" or "distal end" refers to the end portion of the device or element that is closest to the terminal end of a wellbore when measured along the longitudinal axis of the wellbore and regardless of the actual distance from the terminal end of the wellbore.

FIG. 1A illustrates a diagram of a wellbore system ("system") 100, including a safety control apparatus 138 coupled to an electrical submersible pump assembly 120, in accordance with various embodiments. As shown in FIG. 1A, system 100 includes a wellbore 102 extending from a surface 101 in a generally vertical direction through formation 108, the wellbore extending from a wellbore head 103 at surface 101 to a wellbore terminus 105 below the surface. The wellbore 102 as shown in FIG. 1A is enclosed by casing 106, which extends from wellbore head 103 to or near the wellbore terminus 105, the casing encircling and partially enclosing a cavity 104 extending within the casing. At one or more locations along the casing 106, sets of perforations 107 are formed as opening that extend through the casing, and thereby provide fluid communication between fluids, such as oil or other hydrocarbon materials, which are present in the formation 108, and the encased cavity 104 formed within the casing.

A length of production tubing 110 is extended into the encased cavity 104 from the wellbore head 103 toward the wellbore terminus 105, the production tubing having an electrical submersible pump assembly 120 positioned at or near the distal end of the production tubing. A rigging 114, which may comprise a derrick and/or a hoist mechanism (not specifically shown in FIG. 1A, but see rigging 114 in FIG. 1B), may be configured to be operated in order to lower sections of the production tubing 110 including the electrical submersible pump assembly 120 into the wellbore 102 until the ESP assembly 120 is positioned at a desired location within the wellbore. Various centralizer and/or packer assemblies 119 may be positioned long the length of the production tubing 110 in order to stabilize the production tubing within the casing 106, and in various embodiments to isolate sections of the encased cavity 104 from one another. As shown in FIG. 1A, ESP assembly 120 may be positioned adjacent to perforations 107 within the casing 106, so that when the ESP assembly 120 is operated, formation fluid provided from formation 108 and entering an isolated portion 104A of cavity 104 through perforations 107 may be lifted by the ESP assembly in an upward direction through the production fluid passageway 111 of the production tubing 110, and under pressure provided by the operation of the ESP assembly, transported to the surface 101. Upon arrival at the surface 101, the lifted formation fluid may be further channeled through fluid output conduit 112 to one or more processing stations and/or one or more storage tanks (not specifically shown in FIG. 1A).

In various embodiments, ESP assembly 120 comprises a fluid pump 121 that is mechanically coupled to a motor 123 by motor output shaft 125. Fluid pump 121 includes one or more pump impellers 122. When fluid pump 121 is operated by the rotation of the motor output shaft 125, pump impellers 122 are configured to drawn fluid that is present within the isolated portion 104A of the enclosed cavity 104 into the fluid pump 121 through the fluid intake section 129 of the ESP assembly 120, and to provide a fluid pressure configured lift the drawn-in formation fluid in an upward direction through the production fluid passageway 111 to the wellbore head 103 and surface 101.

In various embodiments, motor 123 comprises a permanent magnet motor, which is configured to be powered by electrical energy provided from above surface 101 through motor power cable 130. The permanent magnet motor includes a set of windings on a stator assembly 124 and a rotor assembly 126. The rotor assembly 126 comprises one or more sets of permanent magnets. The stator assembly 124 comprises one or more windings of an electrical conductor, such as copper wire, the one or more windings positioned so that the windings of the stator assembly 124, when electrically energized through electrical energy provided to the motor 123 through motor power cable 130, produces one or more electromagnetic fields that interact with the magnetic fields provided on a continuous basis by the permanent magnets of the rotor assembly 126, causing the rotor assembly to generate rotational motion, which in turn is mechanically coupled to the motor output shaft 125 and in turn rotates the fluid pump 121.

In various embodiments, when the ESP assembly 120 is to be operated in order to lift formation fluids from the wellbore 102 through the production tubing 110, electrical power is provided to motor 123 as follows. Electrical power is provided by electrical line source 139, which in various embodiments is electrical power provided from a power grid, such as would be commercially available from a utility company. In alternative embodiments, the electrical power provided by electrical line source 139 may be provided by an electrical generator, such as a reciprocating natural gas or fossil fuel powered generator set, which may be located on site at the wellbore, or at a remote location. In various embodiments, the electrical power provided by electrical line source 139 is a multi-phase alternating current (AC) power configuration, such as a three-phase power, and in various embodiments is provided in a voltage range from 400 to 600 volts root-mean square (RMS), inclusive.

As shown in FIG. 1A, the electrical power provided by electrical line source 139 is coupled to variable frequency drive 132. Variable frequency drive 132 is configured to condition the power provided by the electrical line source 139 to provide a conditioned power output that is configured to operate the motor 123 of the ESP assembly 120 in the desired manner. Conditioning of the power output provided by the variable frequency drive may include passive or active rectification to Direct Current (DC) voltage of the incoming supply followed by a multi-phase pulse width modulation of the that DC voltage into a controlled voltage in magnitude, phase and frequency supplied to the motor winding through an isolation transformer, and/or any combination thereof. The conditioned output provided by the variable frequency drive 132 is coupled to transformer 134. Transformer 134 is configured to step up the voltage of the conditioned power output received from variable frequency drive 132 to the desired voltage levels for operation of motor 123. In various embodiments, the output from transformer 134 comprises multi-phase electrical power in a range from 800 to 4500 volts RMS, inclusive. The stepped-up voltage output provided from transformer 134 is coupled to Terminal "B" of disconnect switch 136 through electrical connection 131. Electrical connection 131 may include multiple electrical conductors, which are electrically isolated from one another, in order to maintain each of the multi-phases of electrical power provided by transformer 134 on separate ones of the conductors. Disconnect switch 136 is configured to provide a connectable/disconnectable electrical connection between Terminal "B" and Terminal "A" of the disconnect switch. Although shown as a single line in FIG. 1A representing the electrical connection between Terminal "B" and Terminal "A" of the disconnect switch 136, in various embodiments the representation of the electrical connection between Terminal "B" and Terminal "A" comprises multiple electrical conductors, which are electrically isolated from one another, in order to maintain each of the multi-phases of electrical power provided by transformer 134 on separate ones of the conductors.

Terminal "A" is electrically coupled to motor power cable 130, wherein motor power cable 130 extends from Terminal "A" down through wellbore head 103 and within the encased cavity 104 outside of production tubing 110 to motor 123. Motor power cable 130 in various embodiments is a multi-conductor cable with individual conductors that are electrically isolated from one another, each of the individual conductors configured to carry electrical power to motor 123 from the individual phases of electrical power that was provided through disconnect switch 136 from transformer 134. When disconnect switch 136 is configured as shown in FIG. 1A, having Terminal "A" connected to Terminal "B", any electrical power provided from electrical line source 139, as conditioned by variable frequency drive 132 and including voltage levels that have been stepped up by transformer 134, are provided through the disconnect switch 136 and motor power cable 130 to motor 123. When supplied with electrical power through the disconnect switch 136, motor 123 is operated to rotate motor output shaft 125, thereby rotating the pump impellers 122 of fluid pump 121, which in turn allows for formation fluid present in the isolated portion 104A of cavity 104 to be drawn in and lifted through the production fluid passageway 111 of production tubing 110 and toward surface 101, where the formation fluid may be received and further processed and/or stored.

At some point in time, it may be desirable and/or required to stop the operation of the ESP assembly 120, which is normally accomplished by disconnecting the electrical power being provided to motor 123. The reasons for stopping the operation of the ESP assembly 120 include but are not limited to well maintenance such as injection of chemicals to deal with scale, downhole equipment failure requiring equipment change, surface equipment failure, change of artificial lift type for example changing from ESP to gas lift due to production decline, etc. Disconnection of the electrical power from motor 123 may be accomplished by operating disconnect switch 136 from Position "1" to Position "2", wherein the electrical connection between Terminals "A" and "B" is thereby disconnected. The disconnection of the electrical connection between Terminal "A" and Terminal "B" removes the connection of any electrical power being output by transformer 134 to motor power cable 130, which in turn disconnects the motor 123 from any electrical power that may be provided as an output from transformer 134.

In addition, as shown in FIG. 1A operating disconnect switch 136 from Position "1" to Position "2" provides an electrical coupling of Terminal "A" of the disconnect switch 136 to Terminal "C" of the disconnect switch. Terminal "C" of disconnect switch 136 is electrically coupled to safety control apparatus 138 through electrical connection 133. In various embodiments, electrical connection 133 is a multi-conductor electrical cable having a number of individual conductors, which are electrically isolated from one another, and configured to match the number of electrical conductors provided in motor power cable 130.

In various embodiments, disconnect switch 136 is configured as a manually operated switch that is configured to be operated by authorized personnel, such as a field technician, in order to change the electrical connections between Terminal "A" and Terminals "B" or "C". In some embodiments, a manual disconnect switch 136 includes a locking mechanism, such as a lockable hasp, that allows the disconnect switch to be locked out in the position that connects the motor power cable 130 to the safety control apparatus 138, and can only be disconnected by unlocking the locking mechanism in order to prevent unauthorized disconnection of the safety control apparatus 138 from the motor power cable 130. In various embodiments, disconnect switch 136 is configured as a remotely controlled switching device, such as relay contactor or a solid state switching device.

In various embodiments, safety control apparatus 138 is configured to monitor a sense line 137 that is coupled to the electrical connection 131 coupling the disconnect switch 136 to the transformer 134. In such configurations, the safety control apparatus 138 may be configured to sense a state where electrical power is not being provided as an output from transformer 134, and automatically actuates the disconnect switch 136 to disconnect the motor power cable 130 from Terminal "B" of the disconnect switch, and to couple the motor power cable 130 to Terminal "C" and the safety control apparatus 138. This automatic connection to the safety control apparatus can for example prevent a dangerous levels of voltage from being provided from the motor 123 during a power outage wherein the electrical line source 139 is no longer providing electrical power to the system, and/or one of the components such as the variable frequency drive 132 and/or transformer 134, has experienced a failure. In various embodiments, system 100 includes a sense line 135 coupled to the safety control apparatus 138 and configured to allow the safety control system to monitor voltage(s) on the electrical conductors of the motor power cable 130 in order to provide the functions as described above related to automatically switching over the connections provided within disconnect switch 136 for the motor power cable from Terminal "B" to Terminal "C" as a safety precaution.

Compared to other techniques such as motor lockouts and other devices that would need to be downhole, the safety control apparatus 138 of system 100 provides electrical safety for personnel and equipment in the area of the motor power cable 130 while being easier to maintain, as the safety control apparatus of system 100 may be located on the surface 101 in the area of the wellbore 102, as compared to check valves and/or motor lockout devices that need to be positioned downhole within the wellbore, and thus provides a technical improvement to the field of ESP assembly safety.

Figure 1B:
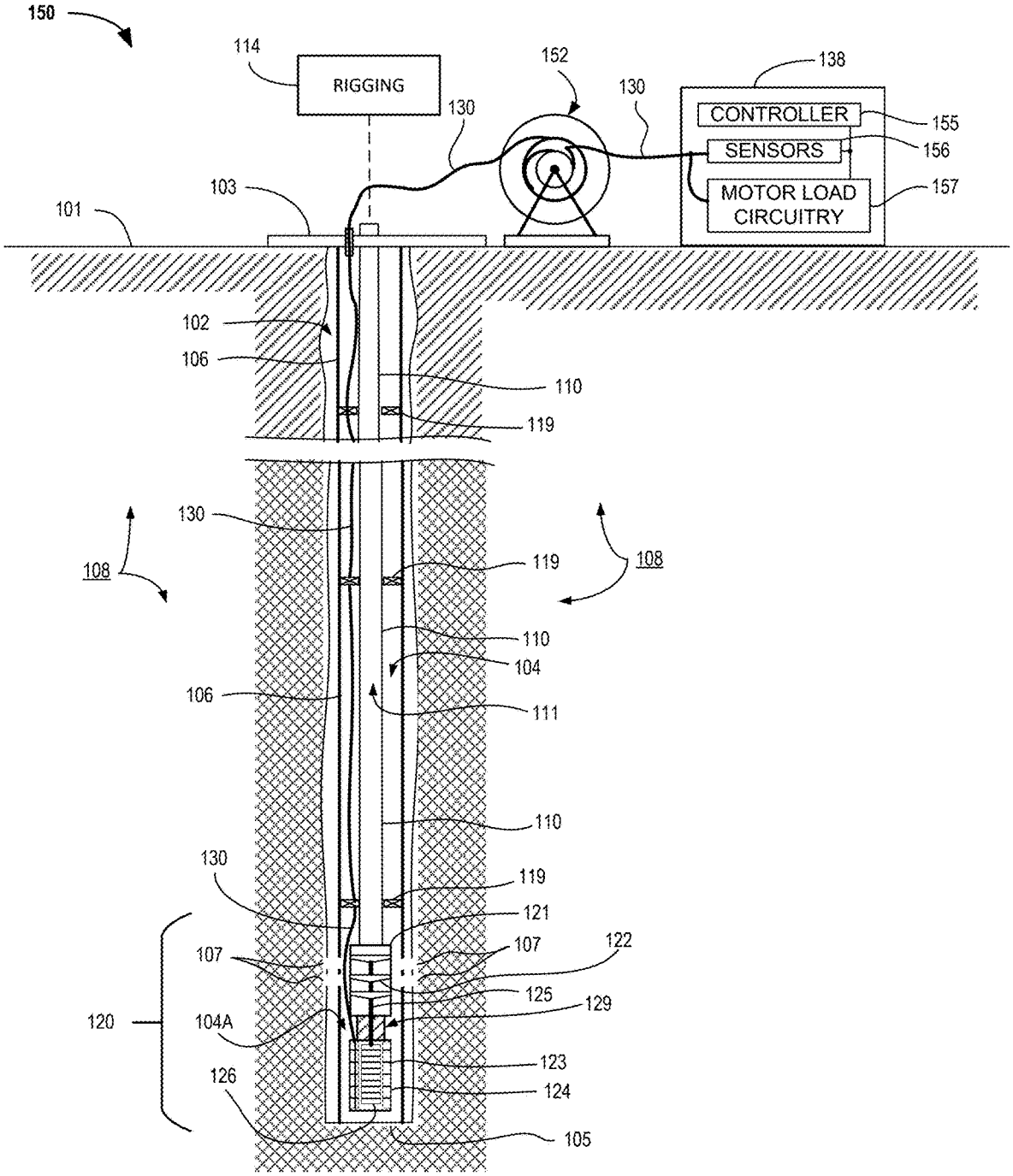
FIG. 1B illustrates a diagram of a wellbore system including a safety control apparatus coupled to an electrical submersible pump assembly, in accordance with various embodiments.

FIG. 1B illustrates a diagram of a wellbore system ("system") 150, including safety control apparatus 138 coupled to an electrical submersible pump assembly 120, in accordance with various embodiments. The system 150 as shown in FIG. 1B may be a stage of the configuration of system 100 of FIG. 1A, such as an installation, removal, or a repositioning stage of the operation of the wellbore 102. Rigging 114, which may comprise a derrick and/or hoist apparatus, may be used when positioning and/or repositioning the production tubing 110 including the ESP assembly 120 into, within, and/or out of wellbore 102. Components shown in system 150 of FIG. 1B that are the same as, or correspond to, the components of system 100 as shown in FIG. 1A retain the same reference numbing in both figures. For example, as shown in FIG. 1B system 150 includes wellbore 102 extending below surface 101 from wellbore head 103 to the wellbore terminus 105, the wellbore encased with casing 106 and including perforations 107, with production tubing 110 including ESP assembly 120 positioned within the wellbore. In a manner similar to system 100 and FIG. 1A, motor power cable 130 is coupled to motor 123 of the ESP assembly 120, and extends upward through the encased cavity 104, through the wellbore head 103, and to the area above surface 101. In various embodiments, safety control apparatus 138 is a portable apparatus that may be moved to the wellbore site and electrically coupled to the motor power cable 130 when the safety protection provided by the safety control apparatus 138 is desired.

In contrast to system 100 of FIG. 1A, system 150 as shown in FIG. 1B does not include, and is not electrically coupled to the electrical line source 139, the variable frequency drive 132, or the transformer 134 as illustrated and described with respect to system 100. Instead, in system 150 a distal portion of the motor power cable 130 that extends above surface 101 is wound around cable reel 152, and wherein the distal end of motor power cable 130 is electrically coupled to safety control apparatus 138. Cable reel 152 is configured to allow portions of the motor power cable 130 to be extended further into the wellbore 102, for example as the ESP assembly 120 is lowered deeper into the wellbore, as part of an initial installation process and/or when repositioning the ESP assembly deeper into the wellbore. Cable reel 152 may also be configured to take in portions of the motor power cable 130 when portions of the electrical power cable or the electrical power cable in its entirety is/are being extracted from the wellbore 102, for example as the ESP assembly 120 is raised within into the wellbore, or in instances wherein the ESP assembly 120 is being removed from the wellbore. In any of the operations where cable reel 152 is rotated to extend portions or to take in distal portion of the electrical power cable, the electrical connection between motor power cable 130 and the devices included in the safety control apparatus 138 are configured to be maintained.

By maintaining the electrical connection between motor power cable 130 and the safety control apparatus 138 at all times, including during times when the ESP assembly 120 is being positioned, repositioned, or is stationary relative to a location within the wellbore, any electrical voltages that might be generated by incidental rotation of the fluid pump 121, and thus induce a voltage in the stator windings of the stator assembly 124 of motor 123 and into the conductors included in motor power cable 130, may be detected by the safety control apparatus 138, and controlled, for example by coupling the conductors of motor power cable 130 to a motor load, such as a resistive load, in order to provide braking to the motor, and thereby safely maintain any voltages that may appear on the motor power cable 130 to at or below a maximum threshold voltage. In various embodiments, the maximum threshold voltage is a voltage, such as but not limited to 50 volts, which would be considered relatively safe for personnel working around the wellbore and/or dealing within any area that might become in contact with motor power cable 130. Without the use of the safety control apparatus 138 when performing operations such as installation, removal, repositioning, or stationary while the ESP assembly 120 is not being intentionally powered for normal operations could result in motor 123 generating voltage levels, for example voltage level in a range from 50 to 4500 volts RMS, which could be present on motor power cable 130 and which could present a shock hazard and/or fire or explosion hazard to personnel in the area of the wellbore.

As shown in FIG. 1B, safety control apparatus 138 includes a controller 155, one or more sensors 156, and motor load circuitry 157. Sensors 156 may be configured to sense and measure the level of any voltages that might be present on the conductors included in motor power cable 130. Output signals from the sensors 156 may be communicated to controller 155. Controller 155 may include one or more computing devices, such as a computer processor and computer memory, which are configured to control operations of the motor load circuitry 157. Motor load circuitry 157 may include one or more switching devices configured to controllably connect and to disconnect the conductors included in motor power cable 130 to and from, respectively, a motor load, such as a resistive load, based on control signals provided to the motor load circuitry by controller 155. Operation of the motor load circuitry 157 may be directed by the controller 155 in order to provide motor braking to motor 123, and thereby maintain any voltages sensed on the conductors of the motor power cable 130 to at or below a maximum threshold voltage. As described above, the maximum threshold voltage may be predetermined to be a voltage level that is considered to be safe to the personnel and the equipment operating in the area of the wellbore 102.

Figure 2A:
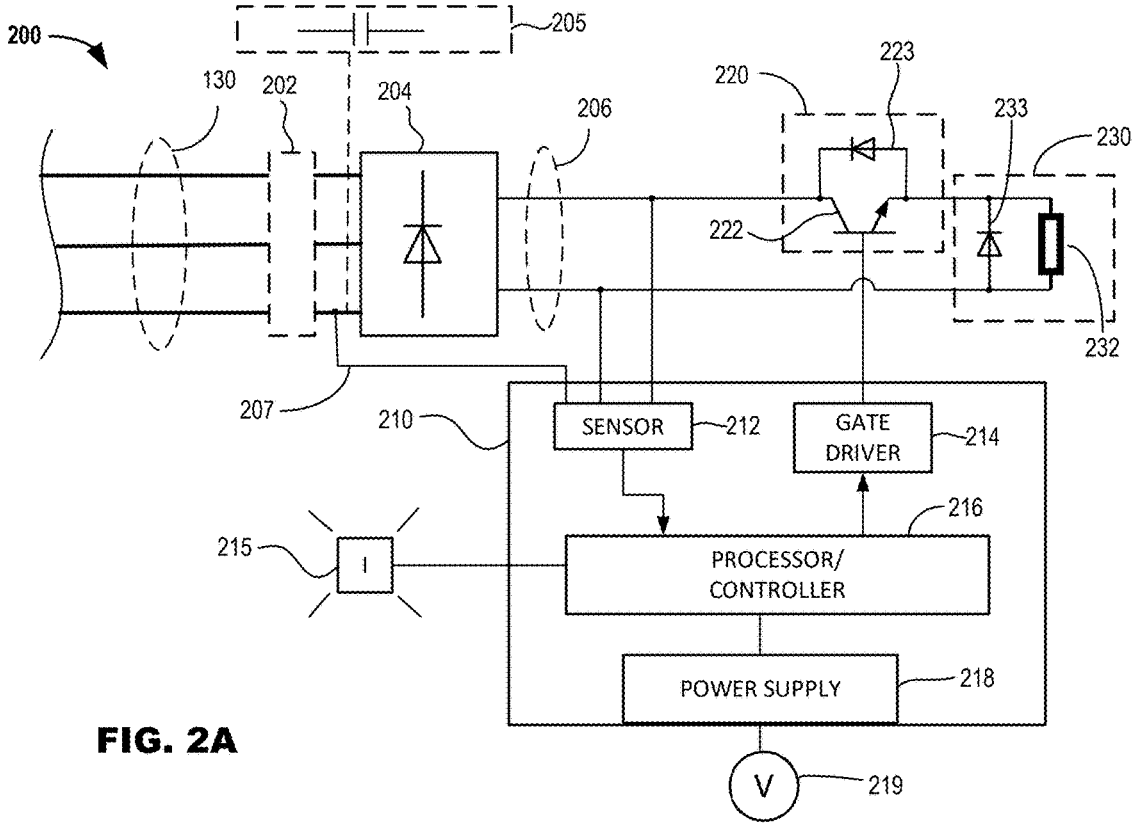
FIG. 2A illustrates a schematic diagram of a safety control apparatus, in accordance with various embodiments.

FIG. 2A illustrates a schematic diagram of a safety control apparatus (apparatus) 200, in accordance with various embodiments. In various embodiments, safety control apparatus 138 (FIG. 1A) may be configured to include the devices, to provide any of the features, and to perform any of the functions described below with respect to apparatus 200, and any equivalents thereof. In various embodiments, safety control apparatus 138 (FIG. 1B) may be configured to include the devices, to provide any of the features, and to perform any of the functions described below with respect to apparatus 200, and any equivalents thereof. As shown in FIG. 2A, apparatus 200 includes rectifier 204, motor load controller 210, motor load switch 220, and motor load 230 that is electrically couplable to motor power cable 130. Motor power cable 130 may be coupled to a motor, such as motor 123 (FIGS. 1A, 1B), which is configured as part of an ESP assembly, such as ESP assembly 120 (FIGS. 1A, 1B). Apparatus 200 is configured to monitor any voltages present on motor power cable 130 when coupled to the motor power cable, and to maintain any voltage present on the motor power cable to a voltage level that is below a maximum threshold voltage. Apparatus 200 may also be configured to monitor the rotational speed of the motor coupled to the motor power cable, and to limit the rotational speed of the motor using the braking provided by motor load 232 as further described below.

In various embodiments, apparatus 200 is coupled to motor power cable 130 through junction box 202, which may be configured to be operated and to provide any of the features and perform any of the functions a describe above with respect to disconnect switch 136 (FIG. 1A). In alternative embodiments, apparatus 200 may be directly coupled to the motor power cable 130, wherein each of the individual electrical conductors included in the motor power cable are coupled as inputs to rectifier 204. Rectifier 204 includes circuitry, such as full wave rectifier circuitry, configured to rectify an alternating current (AC) electrical waveform present on the motor power cable 130 into a direct current (DC) electrical waveform as an output provided at DC output 206.

The DC output 206 is coupled to one or more sensors 212 included as part of the motor load controller 210. Sensors 212 are configured to sense the voltage level present at the DC output 206, and generate an output signal representative of the sensed voltage level, which is provided to the processor/controller 216. Processor/controller 216 includes computing devices, such as a computer processor and computer memory, which enable the processor/controller to provide any of the features and to perform any of the function ascribed to the motor load controller, as described herein, and any equivalents thereof. An example embodiments of processor/controller 216 may include computer system 700 as illustrated and described below with respect to FIG. 7.

Referring back to FIG. 2A, in various embodiments the processor/controller 216 includes a stored and predetermined value for a maximum threshold voltage level. In various embodiments, processor/controller 216 is configured to receive the output signal provided by sensors 212, and determine if the sensed DC voltage level represented by the output signals has reached the maximum threshold voltage level, or is at a value that is below the maximum threshold voltage level. When processor/controller 216 determines that the DC voltage level has reached the maximum threshold voltage level, processor/controller is configured to signal the gate driver 214 in order to actuate the gate driver. Actuation of the gate driver 214 in turn provides an "ON" signal, such as a voltage level, which is applied to the switching device 222 of the motor load switch 220. In various embodiments, switching device 222 is an insulated-gate bipolar transistor (IGBT), which comprises a power semiconductor device that combines a bipolar transistor and a MOS input, wherein IGBTs may be used in high-voltage, high-current applications, such as switching device 222. A diode 223 may be coupled across the switching device 222 as illustrated in FIG. 2A. Embodiments of switching device 222 are not limited to IGBTs, and may include other devices such as but not limited to one or more semiconductor devices, which are rated for the current loads and capable of providing the switching rates that may be required to operate the switching device in the desired manner in order to provide voltage and/or rotational speed regulation of a motor of an ESP assembly that is coupled to the safety control apparatus 200.

In operation, when the "ON" signal is applied to the switching device 222, the switching device is configured to electrically couple the DC output 206 from rectifier 204 to a motor load element 232 of the motor load 230. In various embodiments, motor load element 232 comprises a resistive load. In various embodiments, the motor load element 232 comprises a bank of resistors. In various embodiments, the motor load element 232 comprises a combination of one or more resistors and one or more capacitors. In various embodiments, the motor load element 232 comprises an electrical energy storage device, such as but not limited to a battery and/or one or more capacitors, wherein the electrical energy storage device acts as a motor load in the process of storing electrical energy that is being generated by the rotation of the motor coupled to the motor power cable 130 while at the same time providing the voltage limiting and/or rotational speed limiting functions as ascribed for the motor load element 232 throughout this disclosure. In various embodiments, motor load 230 includes a freewheel diode 233 coupled in parallel with motor load element 232.

With the motor load element 232 coupled through the switching device 222 to the DC output 206, current from the DC output will flow through the motor load element, thus creating a voltage drop across the motor load element and having a braking effect on the rotation of the motor coupled the distal end of motor power cable 130. The braking effect slows the rotational speed of the motor, lowering the voltage level the motor induces into the electrical conductors of the motor power cable 130, and wherein the electrical load provided by the motor load element is configured to provide a level of motor braking, and a corresponding voltage drop that maintains the DC output 206 to a voltage level no higher than the maximum threshold voltage. As described above, the maximum threshold voltage is a voltage level that is considered to be safe for personnel and equipment that might come into contact with motor power cable 130. In various embodiments, as long as the sensed voltage level present at DC output 206 is at the maximum threshold voltage level, processor/controller 216 will continue to signal the gate driver 214 to actuate the switching device 222 to an "ON" state, thereby maintaining the motor load 230 in electrical coupling with the DC output 206, and thereby prevent the voltage level at DC output 206 from exceeding the maximum threshold voltage level. As a result, the voltage level present on any of the electrical conductors provided in motor power cable 130 will also be held to a voltage level that is no higher in value than the maximum threshold voltage level due to the coupling of these individual electrical conductors to the motor load element 232 through rectifier 204 and switching device 222.

In various embodiments, when the sensed voltage level at DC output 206 falls below the maximum threshold voltage level, this lower voltage level will be provided to processor/controller 216 as the output signal from sensors 212. Processor/controller 216 may be configured to receive the output signal indicating the voltage levels below the maximum threshold voltage level and provide an "OFF" signal to gate driver 214 as a result. The "OFF" signal provided to gate driver 214 will in turn provide a signal, such as a voltage level, to switching device 222, which will result in the switching device disconnecting the motor load element 232 from the DC output 206. In various embodiments, the switching device 222 will remain in a state that disconnects the motor load element 232 from the DC output 206 as long as the voltage level present at the DC output remains below the maximum threshold voltage level.

The cycle of processor/controller 216 monitoring the voltage level of DC output 206, as sensed by sensor 212, and controlling the switching "ON" and "OFF" of switching device 222 through gate driver 214, and thus connecting and disconnecting, respectively, the motor load 230 from the DC output 206 allows the processor/controller to maintain the voltage level present at the DC output, and thus on any of the individual electrical conductors included in motor power cable 130, at a voltage level no higher than the predetermined maximum threshold voltage level.

In various embodiments, an AC sense line 207 is coupled between one or more of the electrical conductors of the motor power cable 130 and sensors 212. The AC sense line 207 allows the sensors 212 to determine a frequency of the AC voltages present on the electrical conductors, which can be processed by processor/controller 216 in order to determine the rotational speed of the motor that is coupled to the motor power cable 130. In various embodiments, processor/controller 216 is further configured to control the operation of the switching device(s) of the motor load switch 220 in order to couple the motor load to the electrical conductors of the motor power cable 130 in a manner that provides a level of braking to the motor, thereby limiting the rotational speed of the motor to a predetermined maximum RPM. Limiting the speed of the rotation of the motor may include increasing the amount of time, for example per pulse, that the motor load is connected to the electrical conductors of the motor power cable even when the voltage being induced onto the electrical conductors is below the predetermined threshold voltage. By applying the motor load to the motor for a larger amount of time, i.e., increasing the duty cycle of the control pulses so that the motor load is coupled to the motor for a larger percentage of the pulse-width-modulated cycle, the rotational speed of the motor may also be limited in addition to limiting the voltage level that the motor is inducing onto the electrical conductors of the motor power cable. In various embodiments, in order to limit the rotational speed of the motor, the predetermined threshold voltage limit that is set for the maximum allowable voltage that may be allowed to be induced onto the electrical conductors of the motor power cable is adjusted to a different, in some embodiments a higher maximum voltage level, in order to accommodate the required level of braking needed to achieve the limit to the rotational speed of the motor. In various embodiments, monitoring and control of the braking functions being performed by the safety control apparatus may be based only on limiting the rotational speed of the motor that is coupled to the motor power cable, regardless of the resulting voltage that may occur on the conductors of the motor power cable. The rotational speed only type of regulation would in most cases only be used in situations where field technicians and/or engineers were on site, and/or the arrangement of the location of the motor power cable in its entirety is such that no persons could come into contact with the motor power cable in any manner and no technicians and/or engineers may be on site.

In various embodiments, safety control apparatus 200 may include a set of capacitors 205 coupled across the respective ones of the electrical conductors of the motor power cable that are configured to further limit and/or reduce the time needed to halt the rotation of the motor. In various non-limiting examples, 20 microfarad capacitors were connected between individual electrical conductors of the motor power cable. In another non-limiting embodiment, 30 microfarad capacitors were connected between the individual electrical conductors of the motor power cable 130. The addition of the capacitors may aid in providing an additional braking effect that is effective at higher frequencies that may be produced by the back spinning of the motor that is coupled to the motor power cable.

Embodiments of apparatus 200 may include indicator 215. Indicator 215 may be coupled to processor/controller 216, and configured to be controllably activated by the processor/controller. Indicator 215 is not limited to being any one particular type of indicator, and may include one or more visual indicator, such as a light, a strobe light, and/or a display screen of some form. Indicator 215 may also include one or more audio indicators, such as in the area where indicator 215 is located. In various embodiments, indicator 215 may be activated to provide visual indication (s) and/or audio indication(s) any time the motor load controller 210 has activated the gate driver 214 in order to switch on the switching device 222 based on an indication that the voltage level present on one or more of the electrical conductors included in motor power cable 130 is at the maximum threshold voltage level or that speed control braking is being applied to the motor by the safety control apparatus.

In various embodiments, a power supply 218 is included in the motor load controller 210, the power supply receiving electrical energy from electrical source 219, which may be a commercially available electrical utility, or an on-site electrical generator. Power supply 218 is configured to provide electrical power, at one or more voltage levels, and in the configuration(s) and power levels required to operate the devices included in motor load controller 210.

Figure 2B:
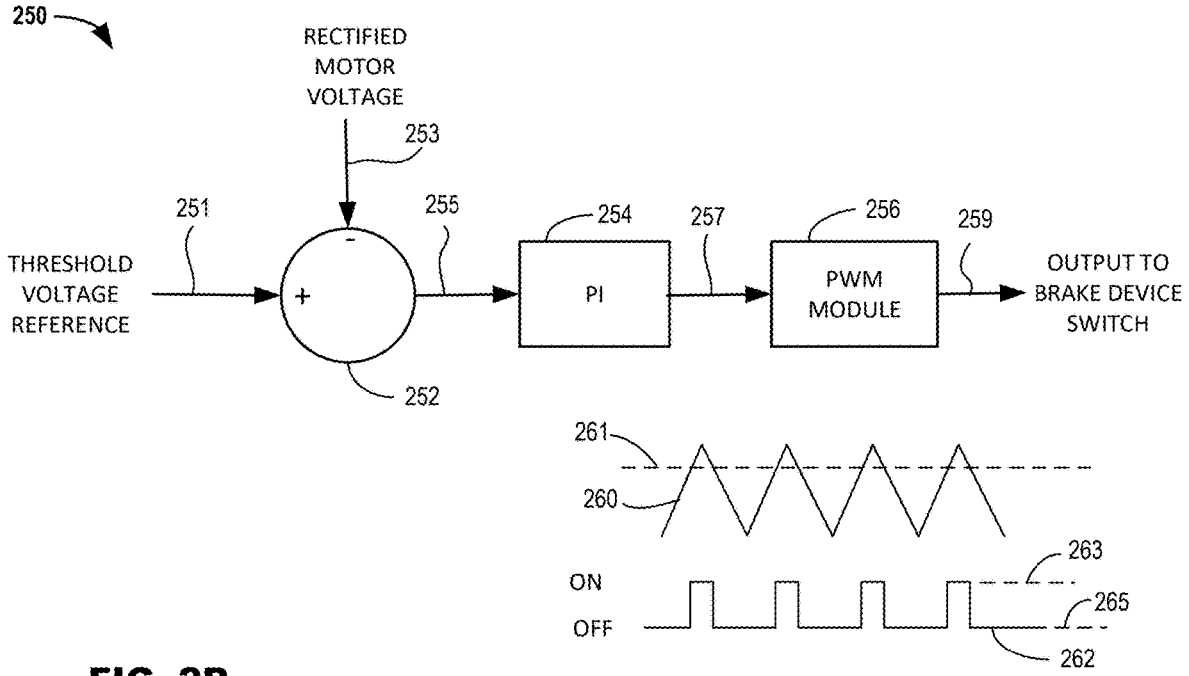
FIG. 2B illustrates a diagram of a control process configured to be performed by a safety control apparatus, in accordance with various embodiments.

FIG. 2B illustrates a diagram of a control process 250 configured to be performed by a safety control apparatus, in accordance with various embodiments. In various embodiments, control process 250 may be performed by any of the safety control apparatus described herein, and any equivalents thereof, including but not limited to safety control apparatus 138 (FIG. 1A), safety control apparatus 138 (FIG. 1B), and safety control apparatus 200 (FIG. 2A).

As shown in FIG. 2B, a predetermined threshold voltage reference at input 251 is provided to combiner 252 as one input, while a rectified motor voltage is provided as input 253 to the combiner. In various embodiments, the value for the threshold voltage reference at input 251 is set to a voltage level that is considered "safe' when present on the electrical conductors of a motor power cable that is coupled to an unpowered submersible pump motor. The value of the rectified motor voltage may be a sensed voltage level that appears on the electrical conductors of the motor power cable, for example due to the unintended rotation of the pump coupled to the motor, which results in the motor generating a voltage on the electrical conductors of the motor power cable, and after the generated voltage has been rectified to a DC waveform.

The output from combiner 252 (arrow 255) may be graphically represented by waveform 260, and is provided to proportional integrator controller (PI) 254. Although shown as a PI controller operation in FIG. 2B, other types of operators, such as a Proportional-Integral-Derivative (PID) controller, may be incorporated and used in control process 250. As shown in FIG. 2B, PI 254 is coupled to Pulse-Width-Modulation Module (PWM module) 256 (arrow 257). PWM module 256 is configured to determine any time that the voltage level of waveform 260 exceeds a predetermined threshold voltage level, the predetermined threshold voltage level illustratively represented by dashed line 261, which is imposed over the graphical representation of waveform 260. At times when the voltage level represented by waveform 260 is below the predetermined threshold voltage level illustratively represented by dashed line 261, PWM module 256 is configured to provide an "OFF" level signal at the output 259. Any time when the voltage level represented by waveform 260 is determined to be at or higher than the predetermined threshold voltage level illustratively represented by dashed line 261, PWM module 256 is configured to provide an "ON" level signal at the output 259. Graphical line 262 is illustrative of the resulting pulses that represent the changes in the status of the output 259 from an "OFF" level (represented by dashed line 265) to an "ON" level, as represented by pulses represented by dashed line 263. In various embodiments the rate of switching may have a frequency in a range up to 5000 cycles per second, and a duty cycle in a range from 0 to 100%.

In various embodiments, a PWM module 256, which may be motor load controller 210 (FIG. 2A), uses the output status of output 259 to alternately switch on and off a switching device, such as switching device 222, which in turn connects and disconnects, respectively, a motor load, such as motor load element 232, to and from the electrical conductors of a motor power cable (e.g., motor power cable 130) in order to regulate the voltage level present on the electrical conductors of the motor power cable to a level equal to or below the predetermined threshold voltage level.

Figure 2C:
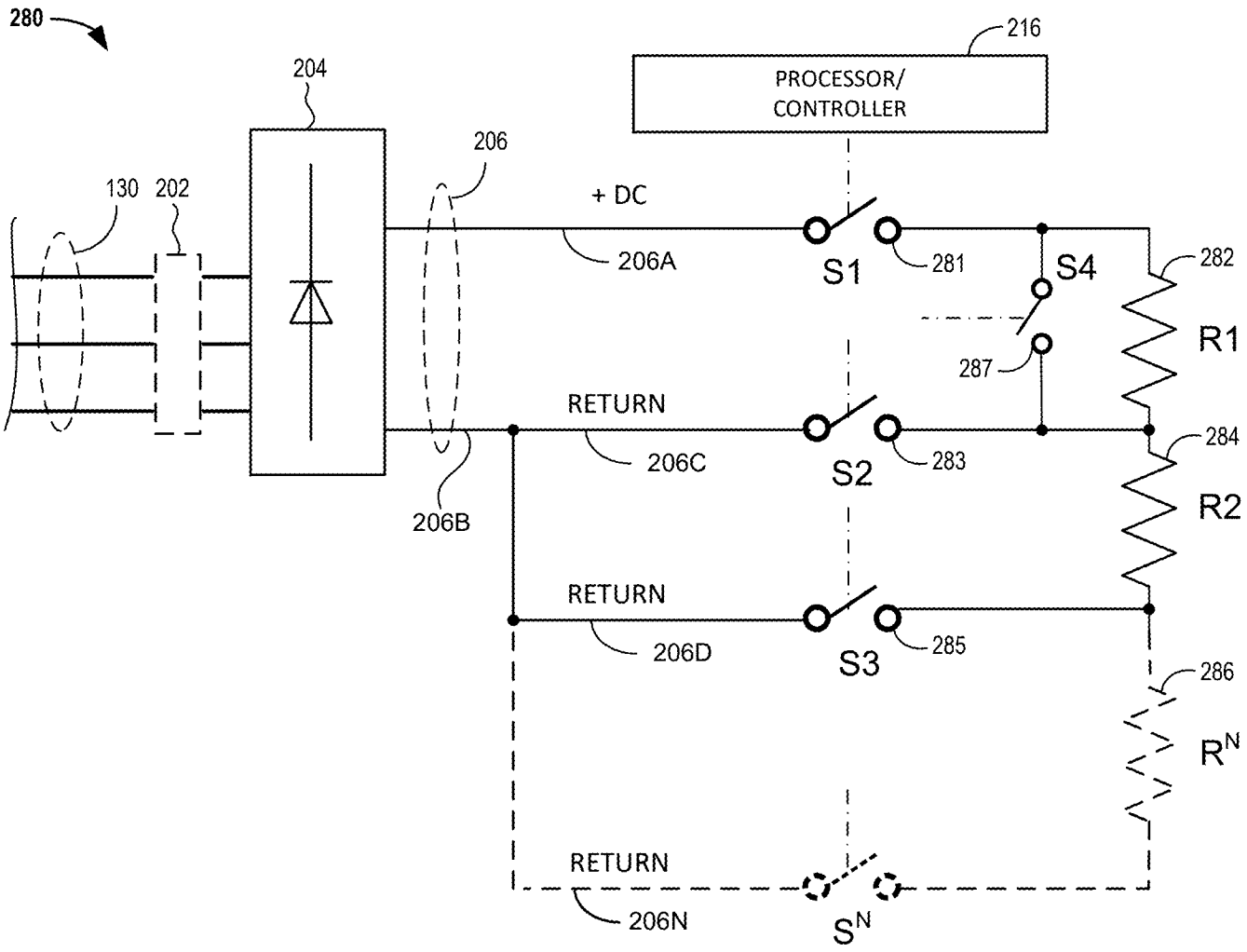
FIG. 2C illustrates a block diagram of a safety control apparatus that comprises a variable value motor load, in accordance with various embodiments.

FIG. 2C illustrates a block diagram of a safety control apparatus (apparatus) 280 that comprises a variable value motor load, in accordance with various embodiments. Apparatus 280 is configured to receive the individual electrical conductors at the proximal end of motor power cable 130 at rectifier 204, either directly or coupled through junction box 202. Rectifier 204 is configured to rectify any voltage level present on the individual conductors of the motor power cable 130, and provide a rectified voltage at DC output 206 in a manner the same as or similar to that described above with respect to safety control apparatus 200 (FIG. 2A). The +DC output 206 provided from the rectifier 204 is electrically coupled to a first side of switch 281 (switch S1) by electrical conductor 206A. The return or −DC side of the DC output 206 as provided from the rectifier 204 is coupled to a first side of switch 283 (switch S2) via electrical conductor 206B, and to a first side of switch 285 (switch S3) via electrical conductor 206C.

A first resistive motor load 282 is coupled between a second side of switch S1 and a second side of switch S2. A second resistive motor load 284 is coupled in series with the first resistive motor load 282, and is also coupled between the second side of switch S2 and a second side of switch S3. Switches S1, S2, and S3 may be controllably switched by control signals provided to the switches from processor/controller 216. Each of the switches S1, S2, and S3 may be controllably opened and closed in a particular arrangement that allows for variation of the level of the resistive load that is being applied to the DC output 206, and thereby to a motor that is coupled to the distal end of motor power cable 130.

For example, when processor/controller 216 may provide control signals that operate to close switches S1 and S2, while leaving switch S3 open. In this configuration, the first resistive motor load R1 only would be coupled across the +DC output of electrical conductor 206A and the –DC return for by electrical conductor 206B. In an alternative configuration, processor/controller 216 may provide control signals that operate to close switches S1 and S3, while leaving switch S2 open. In this configuration, the first resistive motor load R1 in series with the second resistive motor load R2 would be coupled across the +DC output at electrical conductor 206A and the –DC return provided by electrical conductor 206C, coupling a resistive motor load having a higher resistive value to the DC output 206 compared to the first configuration where only resistive motor load R1 is coupled across the DC output 206. This second configuration that includes both resistive motor loads R1 and R2 being coupled across the DC output 206 can be used when use of resistive motor load R1 only is not sufficient to load down and slow the operation of the motor coupled to the distal end of the motor power cable 130.

Alternative arrangements of the switches are possible and contemplated for use in the apparatus 280. For example, embodiments of apparatus 280 may include a fourth switch 287 (switch S4), is coupled to connect the +DC output of electrical conductor 206A directly to the resistor R2, thus bypassing resistive motor load R1 when S4 is closed. In this alternative embodiments, switches S1 and S3 would be also be closed, and switch S2 would be open. Using this configuration, only the resistive motor load R2 would be coupled across the DC output 206, thereby providing another option for altering the amount of resistance that is being applied as a motor load to the motor couped to the distal end of motor power cable 130.

As shown in FIG. 2C, embodiments of apparatus 280 may include some number of resistive motor loads $R^N$ greater than two, and include a number of switches 289 (one or more switches $S^N$) coupling these resistive motor loads in any manner deemed desirable to provide the apparatus 280 with a range of options regarding the level of the resistive motor load that is to be applied to the DC output 206 for the regulation of the motor, and thus the level of voltage present on the individual electrical conductors of the motor power cable 130 when apparatus 280 is being utilized to limit the voltage level that may be present on these individual conductor of the motor power cable. In various embodiments, processor/controller 216 is configured to determine the desired arrangement of resistive motor loads to be applied based on the sensed voltage levels present on the individual electrical conductors of motor power cable 130 and based on the predetermined threshold voltage level that is the maximum voltage level the apparatus 280 is configured to allow to occur on the motor power cable, and to operate the switches of the apparatus 280 in order to achieve the desired level of voltage control on the motor power cable. Variations in the motor load being coupled to the electrical conductors of the motor power cable 130 may also be configured to provide a level of motor load based on limiting a rotational speed of the motor coupled to the motor power cable in addition to or as an alternative to configuring the switched based on voltage level control.

Figure 3:
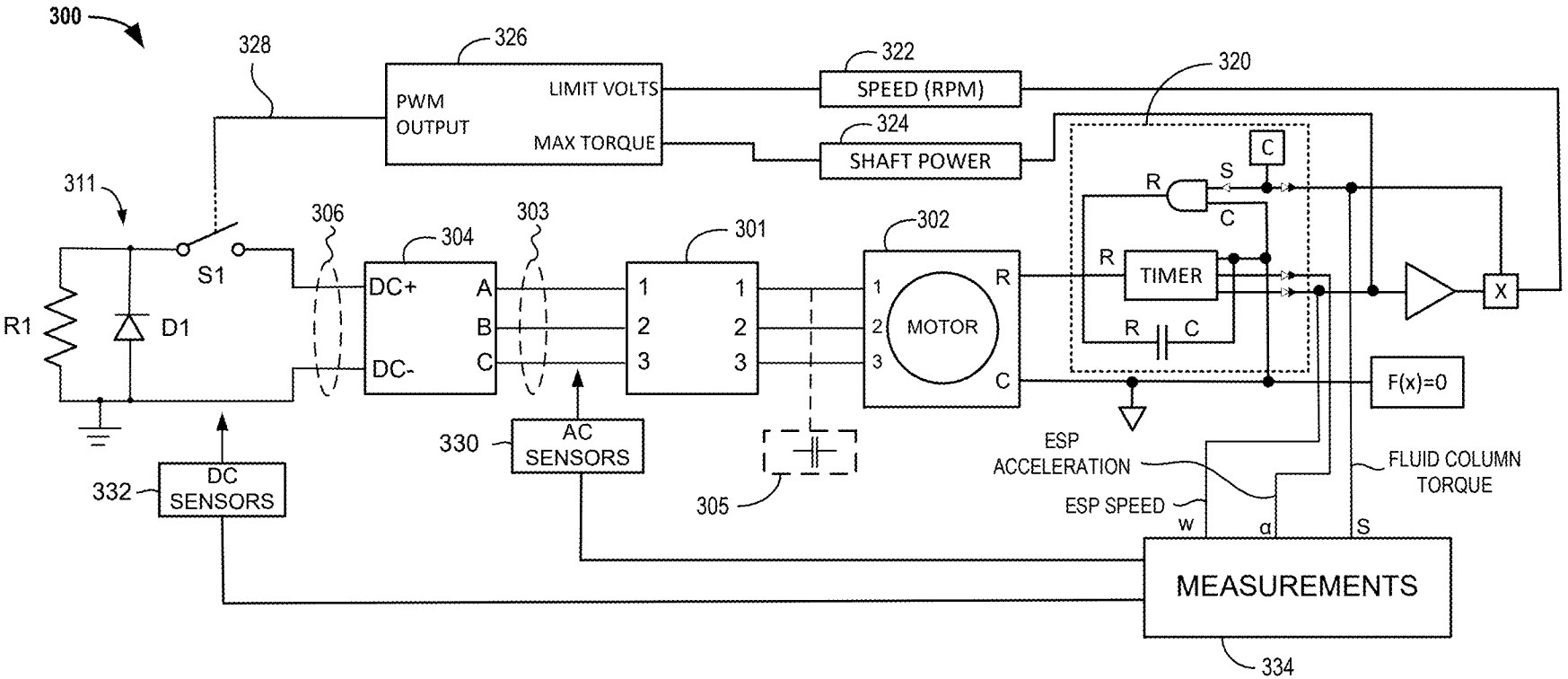
FIG. 3 illustrates a block diagram of a model comprising a motor of an electrical submersible pump apparatus coupled to safety control apparatus, in accordance with various embodiments.

FIG. 3 illustrates a block diagram 300 of a model comprising a motor 302 of an electrical submersible pump apparatus coupled to safety control apparatus, in accordance with various embodiments. In the model, the motor 302 is not being electrically powered from an electrical line source, but is coupled to a safety control apparatus comprising rectifier 304 and motor load circuit 311. Motor 302 is modeled to backspin in order to generate voltage levels on the electrical conductors 303 of the motor power cable 301, wherein the rotational movement of the motor is induced by the rotational motion of the submersible pump (not shown in FIG. 3, but for example the fluid pump 121, as part of ESP assembly 120, FIG. 1A), which is mechanically coupled to the motor. The rotation of motor 302 may be modeled based on various conditions, such as a fluid backflow, which is occurring within a wellbore where the motor being modeled may be positioned.

Various motor control parameters may be provided to test the modeled operation of the motor 302. A modeled torque source 320 may be configured to provide a varying level of torque for the model operation of the motor 302. In one model, the modeled torque source operates the motor as operating based on a fluid column torque level starting at a value of 100 Newton-meters for two seconds, then applying a decaying torque to zero Newton-meters over an eight second time period. The pattern may be repeated any number of times. The value of the fluid column torque and the resultant motor speed are combined to generate a shaft power input 324 to the controller 326. The motor speed is also provided as speed input 322 to controller 326. Based on the inputs provided by the shaft power input 324 and the speed input 322, controller 326 provided a pulse-width-modulated output 328 to control the ON and OFF switching of S1. When in the ON state, the motor load provided by R1 is applied across the DC output 306 of the rectifier 304, and is coupled through motor power cable 301 to provide a load to motor 302. The rate and duration of the ON state is controlled by controller 326 in order to limit the voltage that is being induced in the conductors 303 of by the rotation of motor 302 to a maximum threshold voltage, such as but not limited to 50 volts.

The model may include one or more DC sensors 332 configured to measure one or more electrical parameters, such as voltage, current flow, and power present in the motor load circuit 311. Additional sensors, such as AC sensors 330, may be included to measure one or more electrical parameters, such as voltage, current flow, power, and phase shifts present on the conductors 303 of the motor power cable 301. Measurements may be collected and logged by measurements 334. Embodiments of the model may include a set of capacitors 305 coupled between the individual electrical conductors of the motor power cable 301.

As shown in FIG. 3, the model of motor 302 is configured to operate as a three-phase motor, as indicated by conductors "1", "2", and "3," shown as included in motor power cable 301. The distal end of motor power cable 301 is coupled as inputs to rectifier 304. In various embodiments, rectifier 304 is configured to produce a DC output 306 across outputs DC+ and DC– of the rectifier. In various embodiments, rectifier 304 is a full wave bridge rectifier. The DC output 306 from rectifier 304 is applied across resistance motor load R1 based on the switching signals provided to switch S1 by PWM output 328 from controller 326. In the model, the resistance value of motor load R1 can be varied, and is controlled by resistance values that may be applied to the model. The model illustratively uses a three phase Permanent Magnet Motor (PMM) with a fluid column torque starting at 100 Newton-meters (Nm) and starts to linearly decline at 2.5 seconds for 8 seconds to 0.

Figure 4:
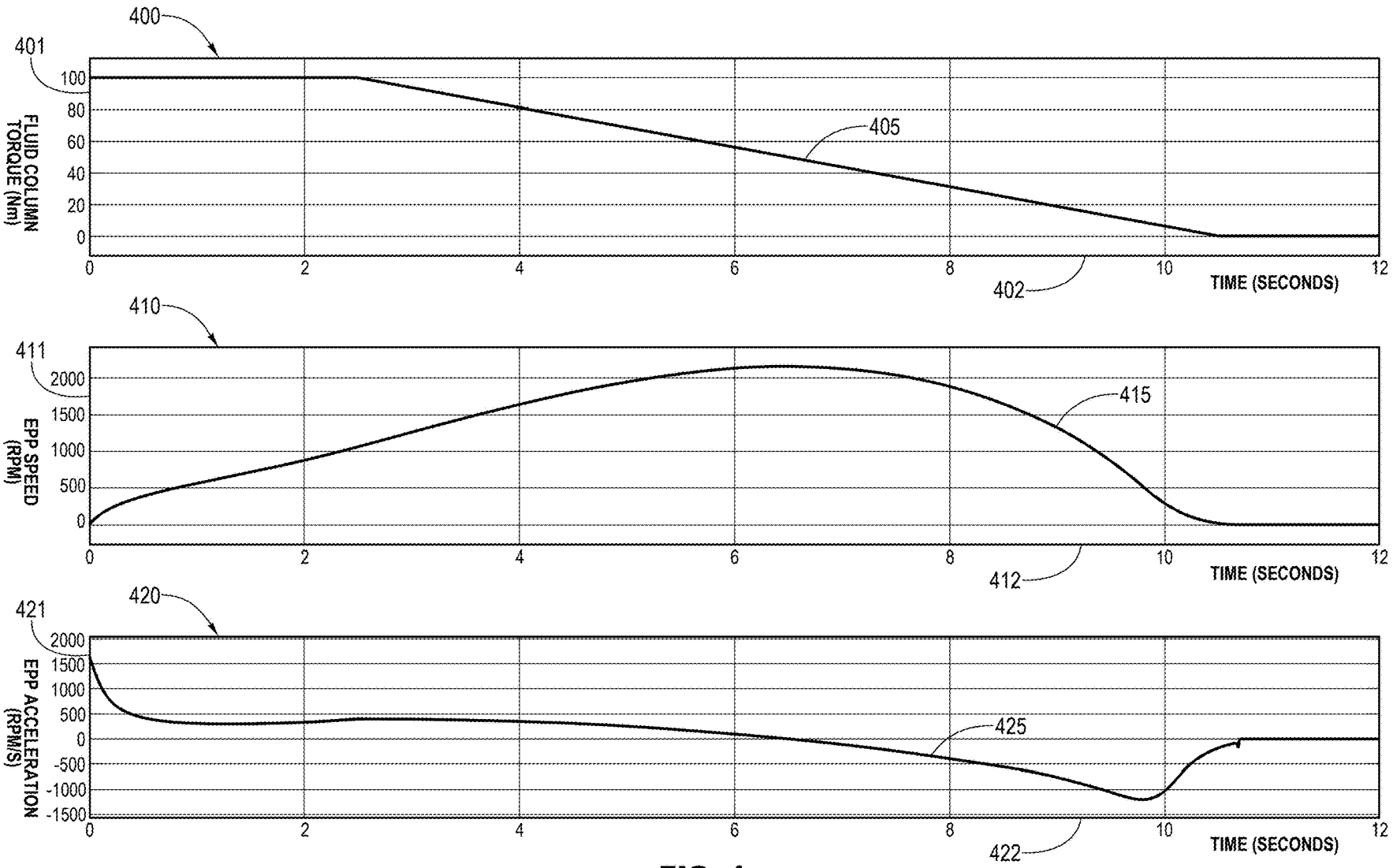
FIG. 4 illustrates a set of graphical representations of various parameter values that were output from the operation of the simulation model of FIG. 3.

FIG. 4 illustrates a set of graphical representations of various parameter values that were output from the operation of the simulation model of FIG. 3.

Graph 400 includes a vertical axis 401 representing fluid column torque in Newton-meters (Nm), and a horizontal axis 402 representing time in seconds. Graphical line 405 illustrates the fluid column torque values in Newton-meters generated over time by the simulation.

Graph 410 includes a vertical axis 411 representing ESP speed in revolutions per minute (RPM), and a horizontal axis 412 representing time in seconds. Graphical line 415 illustrates the ESP speed in revolutions-per-minute (RPM) over time as provided by the simulation.

Graph 420 includes a vertical axis 421 representing ESP acceleration in revolutions-per-minute/second (RPM/second), and a horizontal axis 422 representing time in seconds. Graphical line 425 illustrates the ESP acceleration over time as provided by the simulation.

The timeline for each of graphs 400, 410, and 420 correspond to one another for a same period of time extending from zero to 12 seconds. As illustrated by graphical line 405, at the 10.5 second mark the Fluid Column Torque drops to a value of zero, with a resulting drop in ESP Speed to a value of zero as shown by graphical line 415 in graph 410, and a drop in ESP acceleration to zero as shown by graphical line 425 in graph 420.

Figure 5A:
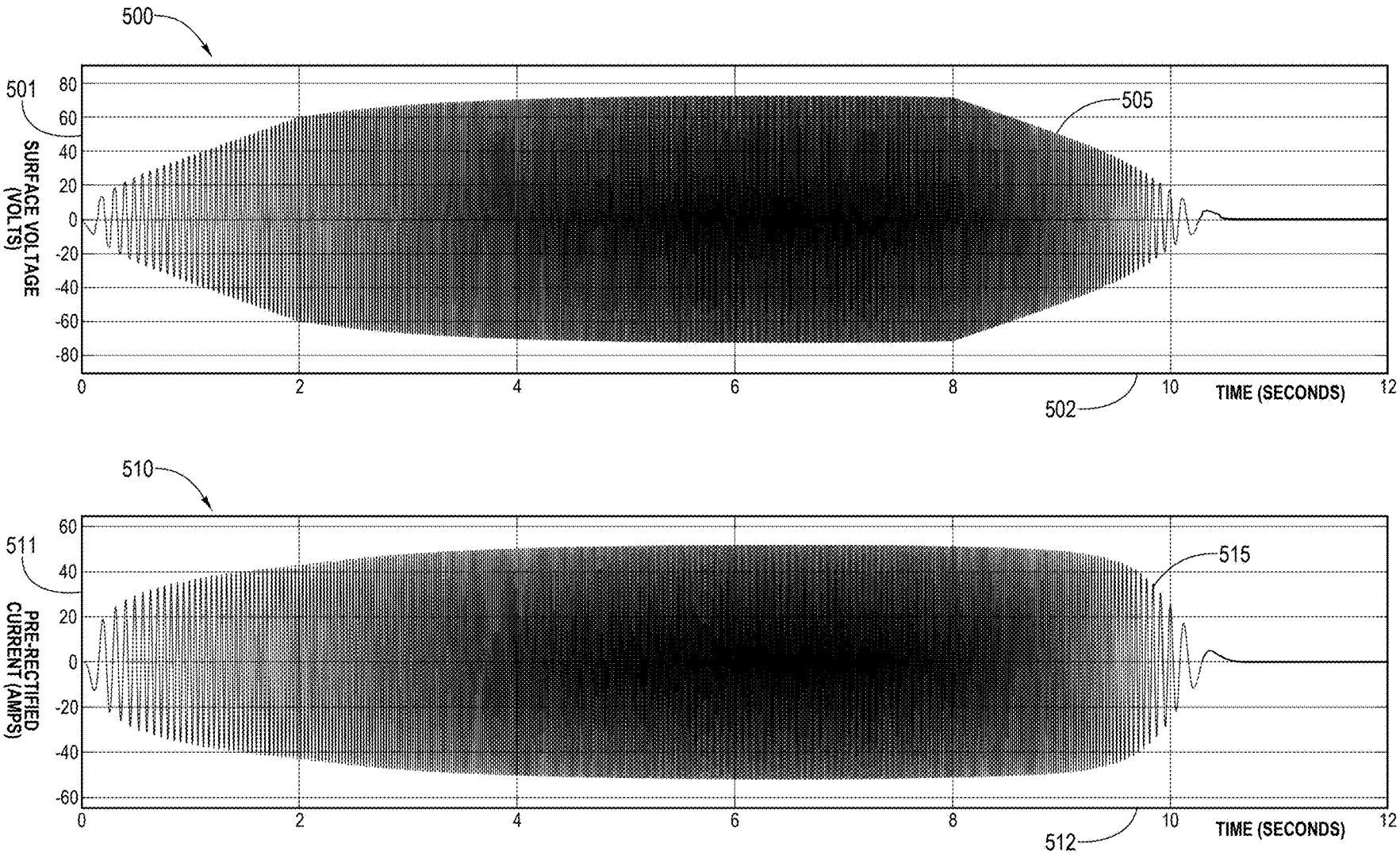
FIG. 5A illustrates a set of graphical representations of various parameter values that were output from the operation of the simulation model of FIG. 3.

FIG. 5A illustrates as set of graphical representations of various parameter values that were output from the operation of the simulation model of FIG. 3.

Graph 500 includes a vertical axis 501 representing an AC voltage levels in volts at the surface on the conductors of the motor power cable, and a horizontal axis 502 representing time in seconds. Graphical line 505 illustrates the AC and unrectified voltage level that was regulated by using of the safety control assembly of FIG. 3 as generated over time by the simulation. As shown in graph 500, the voltage level relative to zero volts is maintained to a level not exceeding 75 volts peak.

Graph 510 includes a vertical axis 511 representing AC current levels in amps at the surface and flowing through the conductors of the motor power cable, and a horizontal axis 512 representing time in seconds Graphical line 513 illustrates the AC current levels generated by the rotation of the motor coupled to the electrical conductors of the motor power cable, and which is applied to the motor load element when using the safety control assembly of FIG. 3 and as generated over time by the simulation.

The timeline for each of graphs 500 and 510 correspond to one another and to the timeline of the graphs in FIG. 4 for a same period of time extending from zero to 12 seconds. As illustrated by graphical line 505, at the 10.5 second mark the surface voltage illustrated in graph 500 drops to a value of zero, along with a drop in the pre-rectified current as illustrated in graph 510 by graphical line 515.

Figure 5B:
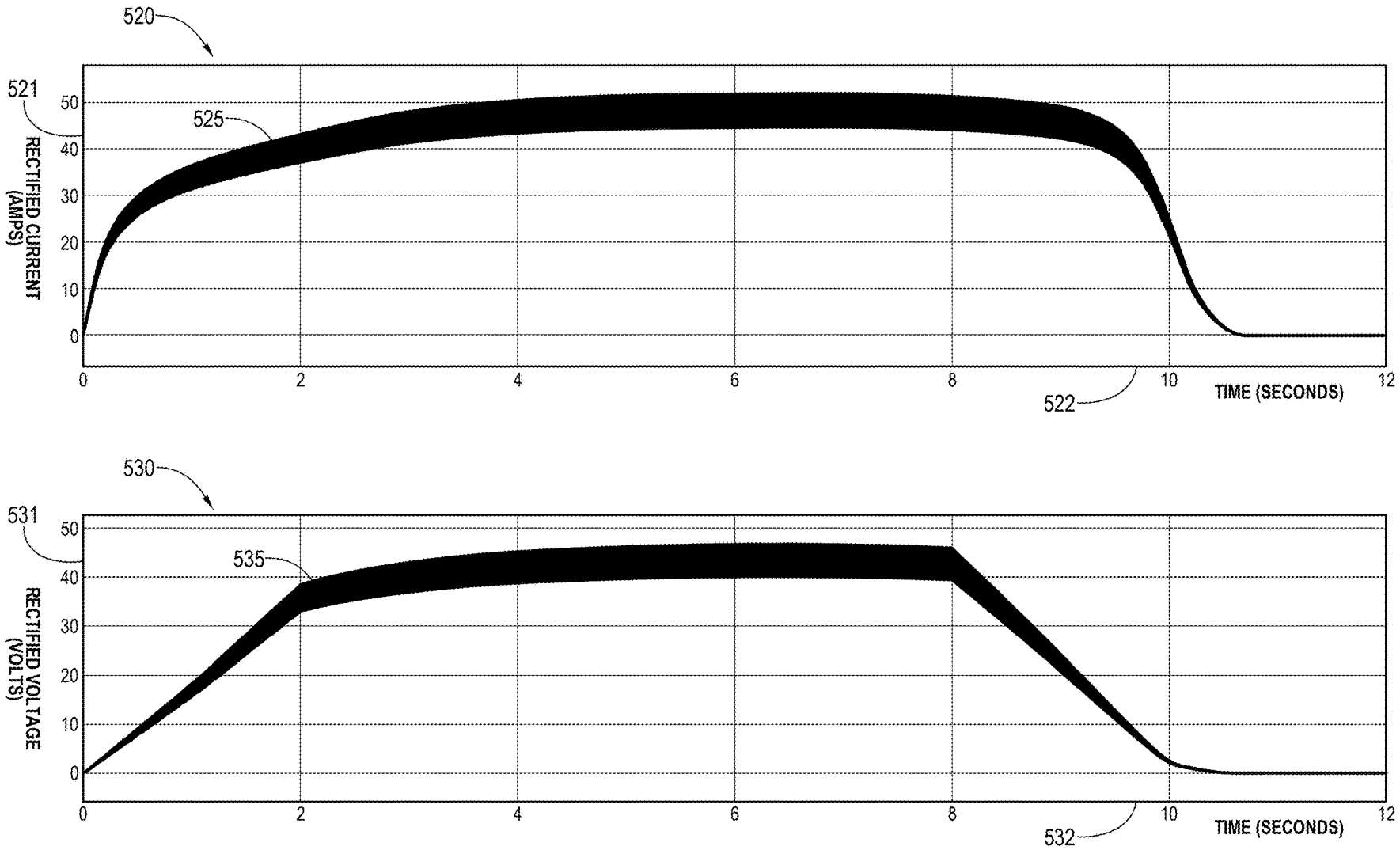
FIG. 5B illustrates a set of graphical representations of various parameter values that were output from the operation of the simulation model of FIG. 3.

FIG. 5B illustrates as set of graphical representations of various parameter values that were output from the operation of the simulation model of FIG. 3.

Graph 520 includes a vertical axis 521 representing rectified current levels in amperes as rectified by the safety control apparatus, and a horizontal axis 522 representing time in seconds. Graphical line 525 illustrates the range of oscillations of current levels that are flowing through the motor load of the safety control apparatus at any given time over the time period between zero and 12 seconds.

Graph 530 includes a vertical axis 531 representing rectified DC voltage levels, in volts, as rectified by the safety control apparatus, and a horizontal axis 532 representing time in seconds. Graphical line 535 illustrates the range of voltage levels oscillations that were present across the motor load of the safety control apparatus over the time period between zero and 12 seconds. As shown in graph 530, the DC voltage levels never reach or exceed a voltage level of 50 volts, which is a predetermined threshold voltage limit for this particular simulation. Other predetermined threshold voltage levels may be set and maintained, based for example customer requirements, which may be below or above the 50 volt level.

The timeline for each of graphs 520 and 530 correspond to one another and to the timelines of the graphs in FIG. 4 and the graphs of FIG. 5A for a same period of time extending from zero to 12 seconds. As illustrated by graphical line 525, at the 10.5 second mark the current level flowing through the motor load drops to a value of zero, along with a drop in the rectified voltage level present across the motor load as shown by graphical line 535 in graph 530.

Figure 6:
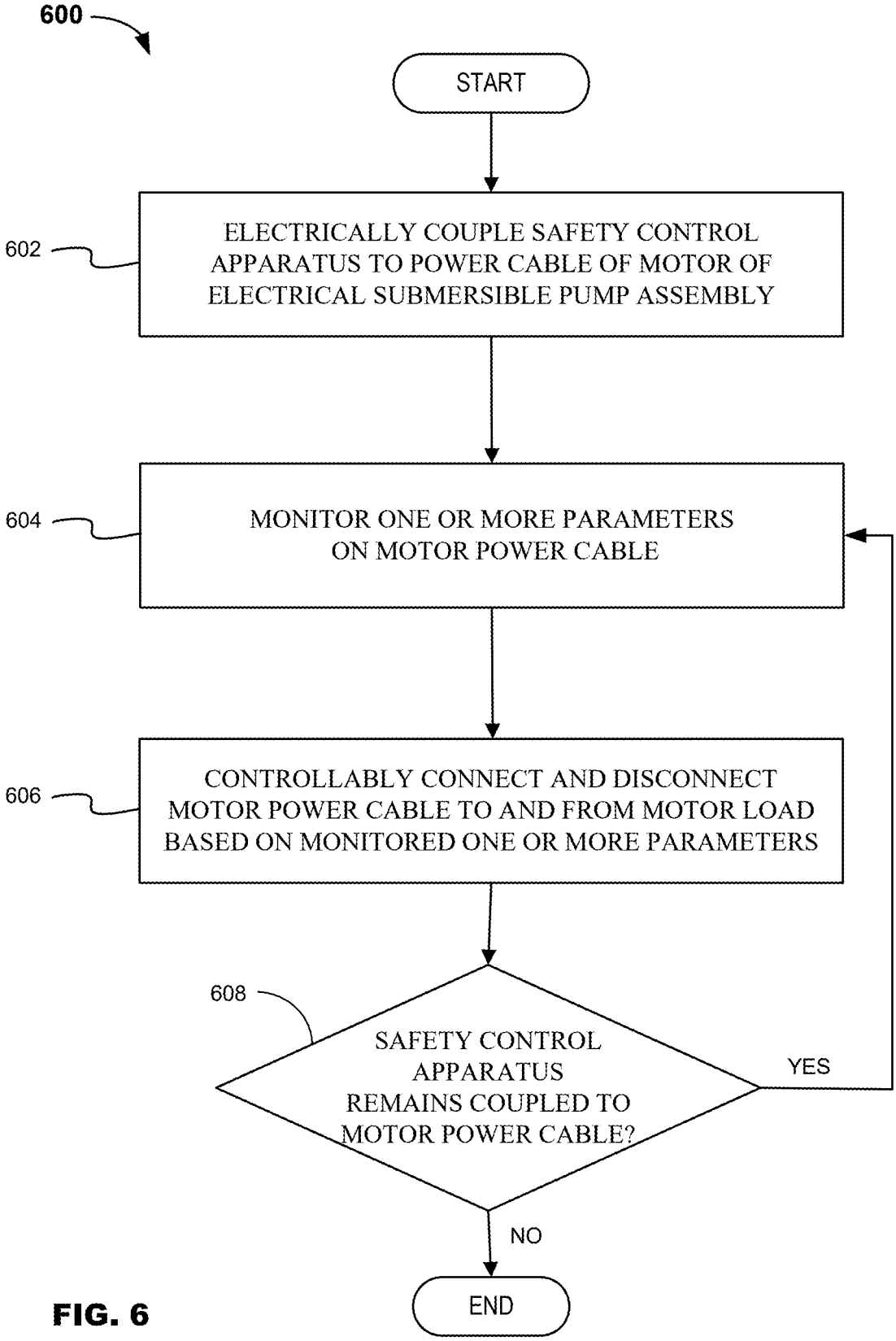
FIG. 6 illustrates a flowchart of one or more methods, in accordance with various embodiments.

FIG. 6 illustrates a flowchart of one or more methods 600, in accordance with various embodiments. Embodiments of method 600 may be performed in part or in whole, by a safety control apparatus, such as safety control apparatus 138 as illustrated and described above with respect to FIG. 1A, by safety control apparatus 138 as illustrated and described above with respect to FIG. 1B, and/or by motor load controller 210 as illustrated and described with respect to FIGS. 2A-2B.

In various embodiments, method 600 includes electrically coupling a safety control apparatus to an electrical power cable of a motor included as part of an electrical submersible pump assembly, (block 602). In various embodiments, a distal end of the electrical power cable is electrically coupled to the motor, and the proximal end of the motor power cable is electrically coupled directly to the inputs, such as rectifier circuitry, of the safety control apparatus. In alternative embodiments, the proximal end of the motor is couplable to the safety control apparatus through a disconnect switch, (such as disconnect switch 136, FIG. 1A). In various embodiments, the proximal end of the motor power cable is connected to the safety control apparatus by having a field technician or other authorized personnel manually operate the disconnect switch in order to disconnect the motor power cable for a line source of electrical power and to connect the individual electrical conductors of the motor power cable to the safety control apparatus.

In various embodiments, the disconnect switch may be operated remotely, for example by using the control line of an electrical power contactor, the electrical power contactor having sets of contacts that may be actuated to connect the proximal end of the motor power cable and each of the individual electrical conductors within the motor power cable to inputs to the safety control apparatus. In various embodiments, the disconnect switch is configured to automatically couple the motor power cable and the individual electrical conductors included in the motor power cable to the inputs of the safety control apparatus whenever a detection has occurred indicating that the line voltage intended to operate the motor is no longer being provided to the motor power cable.

In various embodiments, method 600 includes monitoring one or more parameters present on the electrical conductors included in the motor power cable, (block 604). In various embodiments, monitoring one or more parameters includes monitoring the voltage level present on the electrical conductors included in the motor power cable, and in various embodiments includes coupling any voltages present on the electrical conductors to a rectifier circuit, and rectifying the voltages to provide a rectified voltage level as a DC output. Monitoring the voltage level may further include sensing, using one or more sensors, the rectified voltage level being provided from the rectifier circuit as the DC output, and providing, from the one or more sensors, output signals representative of the sensed voltage level at the DC output. In various embodiments, monitoring one or more parameters includes monitoring a frequency of the AC waveform present on the conductor(s) of the motor power cable, for example using one or more frequency sensors, and providing, from the one or more frequency sensors, output signals representative of the sensed frequency present on the conductors of the motor power cable.

In various embodiments, method 600 includes controllably connecting and disconnecting the motor power cable to and from, respectively, a motor load based on the monitored one or more parameters present on the conductors of the motor power cable, (block 606). The controllably connecting and disconnecting of the motor power cable from the motor load may be performed using a pulse width modulated output control signal configured to connect and disconnect the electrical conductors of the motor power cable from the motor load in a manner that provides braking to the motor, thereby limiting the rotational speed of the motor and thus limiting the voltage level that is impressed onto the electrical conductors of the motor power cable to below a predetermined threshold voltage level.

In various embodiments, connection between the motor load and the electrical conductors of the motor power cable is made based on a determination that the voltage level present on the individual electrical conductors of the motor power cable has reached a predetermined threshold voltage level, and disconnection of the motor load from the electrical conductors of the motor power cable is made based on a determination that the voltage level present on the individual electrical conductors is below the predetermined threshold voltage level. Connection and disconnection of the motor load from the individual electrical conductors included in the motor power cable may be provided by the operation of one or more switching devices, such as switching device 222 (FIG. 2A), which may comprise but is not limited to an IGBT device, which in turn may be controlled by a controller/processor, such as processor/controller 216 (FIG. 2A, 2B).

Embodiments of method 600 may also include determining the rotational speed of the motor coupled to the motor power cable and adjusting one or more parameters of controllably connecting and disconnecting the electrical conductors of the motor power cable to and from, respectively, a motor load in order to limit the rotational speed of the motor. In various embodiments, the rotational speed of the motor may be determined by sensing the frequency of the AC voltage(s) present on the electrical conductor(s) of the motor power cable. Limiting the speed of the rotation of the motor may include increasing the amount of time, for example per pulse, that the motor load is connected to the electrical conductors of the motor power cable even when the voltage being induced onto the electrical conductors is below the predetermined threshold voltage. By applying the motor load to the motor for a larger amount of time, i.e., increasing the duty cycle of the control pulses so that the motor load is coupled to the motor for a larger percentage of the pulse-width-modulated cycle, the rotational speed of the motor may also be limited in addition to limiting the voltage level that the motor is inducing onto the electrical conductors of the motor power cable. In various embodiments, in order to limit the rotational speed of the motor, the predetermined threshold voltage limit that is set for the maximum allowable voltage that may be allowed to be induced onto the electrical conductors of the motor power cable is adjusted to a different, in some embodiments a higher maximum voltage level to accommodate the required level of braking needed to achieve the limit to the rotational speed of the motor. In various embodiments, monitoring and control of the braking functions being performed by the safety control apparatus may be based only on limiting the rotational speed of the motor that is coupled to the motor power cable, regardless of the resulting voltage that may occur on the conductors of the motor power cable. The rotational speed only type of regulation would only be used in situations where field technicians and/or engineers were on site, and/or the arrangement of the location of the motor power cable in its entirety is such that no persons could come into contact with the motor power cable in any manner and no technicians and/or engineers may be on site.

In various embodiments, method 600 includes determining that the safety control apparatus remains electrically coupled to the electrical conductors of the motor power cable, (decision block 608). When a determination is made that the safety control apparatus remains electrically coupled to the electrical conductors of the motor power cable, (the "YES" branch extending from decision block 608), embodiments of method 600 return to block 604, including monitoring of the voltage levels present on the electrical conductors of the motor power cable, and block 606, including controllably connecting and disconnecting the electrical conductors of the motor power cable to and from, respectively, a motor load based on the monitored voltage level present on the conductors of the motor power cable. When a determination is made that the safety control apparatus is no longer electrically coupled to the electrical conductors of the motor power cable, (the "NO" branch extending from decision block 608), embodiments of method 600 end until such time when the safety control apparatus is again electrically coupled to the electrical conductors of the motor power cable.

Figure 7:
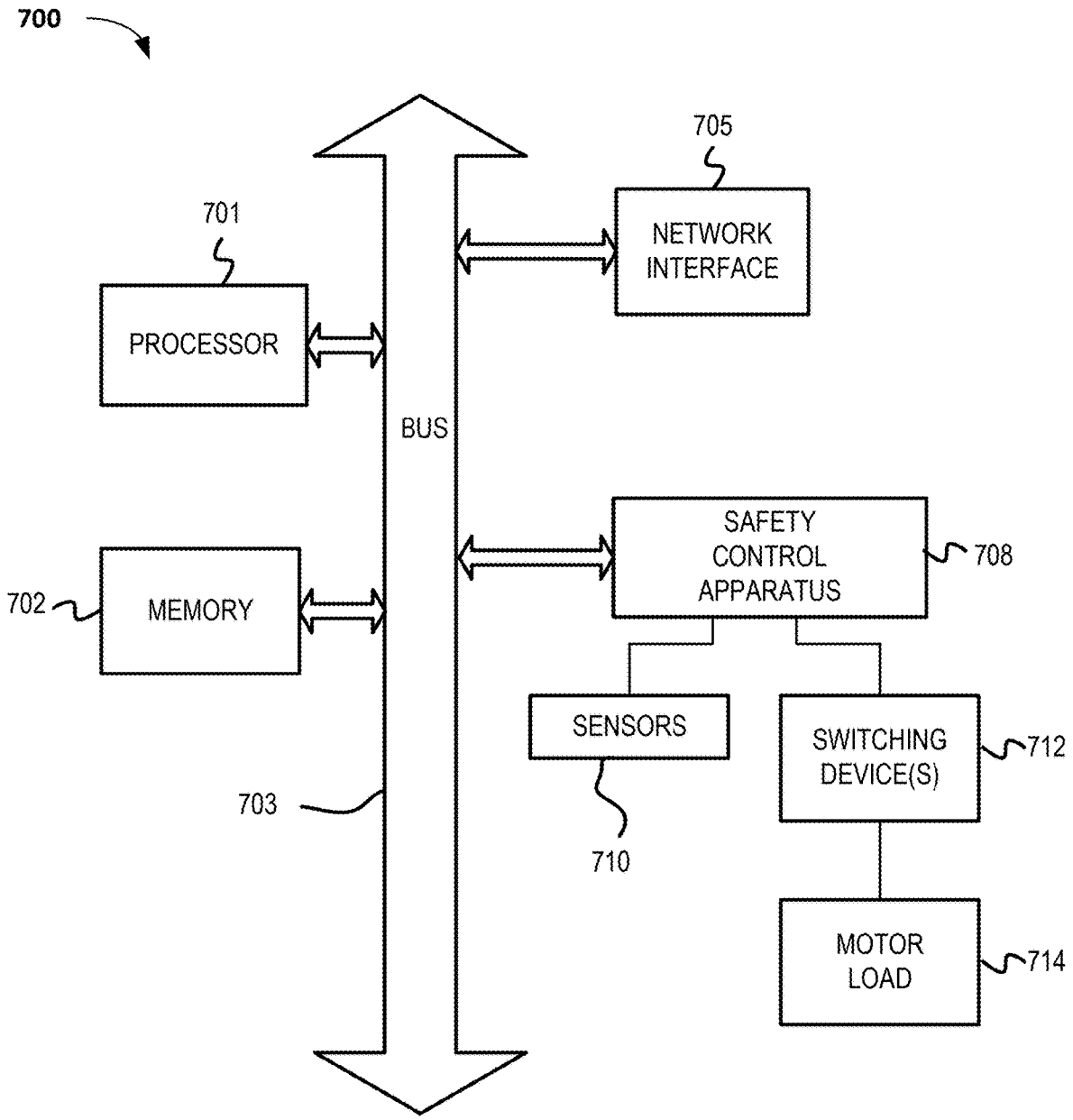
FIG. 7 illustrates a computer system, in accordance with various embodiments.

FIG. 7 illustrates a computer system 700, in accordance with various embodiments. Computer system 700 may be, at least in part, portions of the safety control apparatus 138 as illustrated and described above with respect to FIG. 1A, safety control apparatus 138 as illustrated and described above with respect to FIG. 1B, and/or motor load controller 210 as illustrated and described above with respect to FIG. 2A.

As shown in FIG. 7, computer system 700 includes a processor 701, (possibly including multiple processors, multiple cores, multiple nodes, and/or implementing multithreading, etc.), and memory 702. The memory 702 may be system memory or any one or more of the below described possible realizations of machine-readable media. Computer system 700 also includes a bus 703 that communicatively couples processor 701 and memory 702. Embodiments of computer system 700 also include network interface 705 and safety control apparatus 708, which are also communicably coupled to bus 703.

The computer system 700 may be configured to communicate via transmissions to and/or from remote devices via the network interface 705 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.).

Safety control apparatus 708 may be configured to provide any of the features and to perform any of the functions ascribed to the safety control apparatus and/or to the motor control apparatus as described herein, and any equivalents thereof. In various embodiments, safety control apparatus 708 is coupled to one or more sensors 710, wherein sensors 710 may be configured to transmits output signals to the safety control apparatus that are representative of voltage levels sensed on a motor power cable that is electrically coupled to a motor of an ESP assembly. In various embodiments, a frequency of the AC waveforms present on the motor power cable is also sensed using the one or more sensors 710, and an output signal representative of the sensed frequency is provided to the processor 701 for use in determining the rotational speed of the motor coupled to the motor load 714. In addition, embodiments of safety control apparatus 708 are configured to provide an output signal to one or more switching devices 712, for example in a pulse width modulated control signal waveform, the output signal configured to control the operation of the one or more switching devices 712 in order to controllably connect and disconnect a motor load 714, such as a resistor or a bank of resistors and/or an electrical energy storage device, to and from, respectively, the motor that is electrically coupled to the motor power cable being monitored by sensors 710.

The operation of the one or more switching devices 712 is configured to load the motor in a way that acts as a brake to limit the rotational speed of the motor, and thereby regulate the voltage level induced by the motor onto the conductors of the motor power cable. In various embodiments, the operation of the safety control apparatus 708 to control the one or more switching devices 712 is configured to limit the voltage level impressed onto the electrical conductors of the motor power cable to a level that is at or below a predetermined threshold voltage level. In various embodiments, the operation of the safety control apparatus 708 is configured to also limit the rotational speed of a motor coupled to the motor load 714 to some predetermined maximum RPM value by utilizing the braking functions provided by the operation of the safety control apparatus. Information and data that may be stored in memory 702 includes storage of the value of the predetermined threshold voltage level and/or rotational speed limits for the motor coupled to the motor power cable, and programming configured for the operation of the safety control apparatus 708. This stored information may be stored as machine readable code, and operated on by processor 701 in order to provide any of the features and to perform any of the function ascribed to the safety control apparatus and motor control apparatus as described throughout this disclosure, and any equivalents thereof.

In various embodiments, the functionality of the safety control apparatus and the motor control apparatus may be implemented with an application specific integrated circuit, in logic implemented in the processor 701, in a co-processor on a peripheral device or card, etc. Further, realizations may include fewer or additional components not illustrated in FIG. 7 (e.g., video cards, audio cards, additional network interfaces, peripheral devices, etc.). Although illustrated in FIG. 7 as being coupled to the bus 703, the memory 702 may be coupled directly to the processor 701.

It will be understood that one or more blocks of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus, which may be included but are not limited to devices included in computer system 700. As will be appreciated, aspects of the disclosure may be embodied as a system, method or program code/instructions stored in one or more non-transitory machine-readable media. Accordingly, aspects may take the form of hardware, software (including firmware, resident software, microcode, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a general purpose computer, some embodiments can be any type of device or apparatus to perform operations described herein.

As will be appreciated, aspects of the disclosure may be embodied as a system, method or program code/instructions stored in one or more non-transitory machine-readable media. Accordingly, aspects may take the form of hardware, software (including firmware, resident software, microcode, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, which employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device. A machine readable storage medium is not a machine readable signal medium.

While the aspects of the disclosure are described with reference to various implementations and exploitations, it will be understood that these aspects are illustrative and that the scope of the claims is not limited to them. In general, techniques for providing and actuating safety control apparatus in a wellbore as described herein may be implemented with facilities consistent with any hardware system or hardware/software systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Non-Limiting Example Embodiments Include the Following:

Embodiment 1. A system comprising: a safety control apparatus configured to be electrically coupled to a motor power cable of a motor, the motor configured to operate a submersible pump, the motor and the submersible pump configured to be deployed downhole in a wellbore and operated to pump a fluid present within the wellbore into a production tubing or conduit extending within the wellbore, wherein the safety control apparatus comprises a controller coupled to a switching device, the controller configured to operate the switching device to controllably connect and disconnect a set of electrical conductors of the motor power cable to and from, respectively, one or more motor loads in order to maintain a voltage level present on the set of electrical conductors of the motor power cable at or below a threshold voltage level when the motor is not being powered to operate the submersible pump and when the motor is being mechanically rotated by a flow of fluid passing through the submersible pump.

Embodiment 2. The system of embodiment 1, wherein the safety control apparatus further comprises a rectifier configured to be electrically coupled to the set of electrical conductors of the motor power cable, the rectifier configured to rectify the voltage level present on the set of electrical conductors and to rectify the voltage level to provide a direct current output voltage as a DC output.

Embodiment 3. The system of embodiment 2, wherein the safety control apparatus is configured to operate the switching device based on a comparison of the DC output to a predetermined value of a threshold voltage limit.

Embodiment 4. The system of any one of embodiments 1-3, wherein operation of the switching device to controllably connect and disconnect the motor power cable to and from, respectively, the one or more motor loads comprises providing a pulse-width-modulated signal generated by the controller to an input of the switching device.

Embodiment 5. The system of embodiment 4, wherein a width of a pulse of the pulse-width-modulated signal is determined by a time period when a sensed voltage level that is present on the set of electrical conductors of the motor power cable is at or above a maximum threshold voltage level.

Embodiment 6. The system of any one of embodiments 1-5, wherein the one or more motor loads comprise an electrical resistor.

Embodiment 7. The system of any one of embodiments 1-5, wherein the one or more motor loads comprises an electrical energy storage device.

Embodiment 8. The system of any one of embodiments 1-7, wherein the switching device comprises an insulated-gate bipolar transistor.

Embodiment 9. The system of any one of embodiments 1-8, wherein the safety control apparatus is configured to limit a speed of rotation of the motor using the one or more motor loads.

Embodiment 10. The system of any one of embodiments 1-9, wherein the threshold voltage level is 50 volts.

Embodiment 11. A method comprising: electrically coupling a safety control apparatus to a set of electrical conductors of a motor power cable that are coupled to a motor of an electrical submersible pump apparatus, the electrical submersible pump apparatus configured to be positioned within a wellbore and configured to be operated by the motor in order to provide an artificial lift of formation fluids from within the wellbore; monitoring, by the safety control apparatus, a voltage level that is present on the set of electrical conductors of the motor power cable; and controllably connecting and disconnecting, using at least one switching device, the set of electrical conductors of the motor power cable to and from, respectively, a motor load configured to limit the voltage level that is present on the set of electrical conductors to a predetermined threshold voltage level based on the monitoring of the voltage level present on the set of electrical conductors of the motor power cable.

Embodiment 12. The method of embodiment 11, wherein the monitoring of the voltage level on the set of electrical conductors of the motor power cable comprises rectifying voltages present on the set of electrical conductors to provide a direct current (DC) output voltage, and monitoring a level of the DC output voltage.

Embodiment 13. The method of embodiments 11 or 12, wherein controllably connecting and disconnecting the set of electrical conductors of the motor power cable to and from, respectively, the motor load comprises providing a pulse-width-modulated signal to an input of the at least one switching device.

Embodiment 14. The method of any one of embodiments 11-13, further comprising controllably connecting and disconnecting the set of electrical conductors of the motor power cable to and from, respectively, the motor load to limit a speed of rotation of the motor.

Embodiment 15. The method of any one of embodiments 11-14, wherein the predetermined threshold voltage level is 50 volts.

Embodiment 16. The method of any one of embodiments 11-15, wherein a connection between the set of electrical conductors of the motor power cable and the motor load is made based on a determination that the voltage level present on the set of electrical conductors of the motor power cable has reached the predetermined threshold voltage level, and a disconnection of the set of electrical conductors of the motor power cable from the motor load is made based on a determination that the voltage level present on the set of electrical conductors of the motor power cable is below the predetermined threshold voltage level.

Embodiment 17. The method of any one of embodiments 11-16, wherein electrically coupling the safety control apparatus to the set of electrical conductors of the motor power cable further comprises: monitoring an electrical line source that is coupled to the set of electrical conductors of a motor power cable to determine that the electrical line source is providing electrical power to the set of electrical conductors of the motor power cable; and automatically, using a disconnect switch, disconnecting the set of electrical conductors of the motor power cable from the electrical line source and connecting the set of electrical conductors of the motor power cable to the safety control apparatus.

Embodiment 18. A non-transitory, computer-readable medium having instructions stored thereon that are executable by a processor to perform operations comprising: monitoring, using one or more output signals received from one or more sensors, a voltage level that is present on a set of electrical conductors of a motor power cable coupled to a motor of an electrical submersible pump assembly; and providing an output signal to controllably connect and disconnect, using at least one switching device, the set of electrical conductors of the motor power cable to and from, respectively, a motor load configured to limit the voltage level present on the set of electrical conductors to a predetermined threshold voltage level based on the monitoring of the voltage level present on the set of electrical conductors.

Embodiment 19. The non-transitory, computer readable medium of embodiment 18, wherein monitoring the voltage level present on the set of electrical conductors of the motor power cable comprises rectifying voltages present on the set of electrical conductors to provide a direct current (DC) output voltage, and monitoring a level of the DC output voltage.

Embodiment 20. The non-transitory, computer readable medium of embodiments 18 or 19, further comprising controllably connecting and disconnecting the set of electrical conductors of the motor power cable to and from, respectively, the motor load to limit a speed of rotation of the motor.

What is claimed is:

1. A system comprising:

a safety control apparatus configured to be electrically coupled to a motor power cable of a motor, the motor configured to operate a submersible pump, the motor and the submersible pump configured to be deployed downhole in a wellbore and operated to pump a fluid present within the wellbore into a production tubing or conduit extending within the wellbore, wherein the safety control apparatus comprises a controller coupled to a switching device, the controller configured to operate the switching device to controllably connect and disconnect a set of electrical conductors of the motor power cable to and from, respectively, one or more motor loads in order to maintain a voltage level present on the set of electrical conductors of the motor power cable at or below a threshold voltage level when the motor is not being electrically powered to operate the submersible pump and when the motor is being mechanically rotated by a flow of fluid passing through the submersible pump.

2. The system of claim 1, wherein the safety control apparatus further comprises a rectifier configured to be electrically coupled to the set of electrical conductors of the motor power cable, the rectifier configured to rectify the voltage level present on the set of electrical conductors and to rectify the voltage level to provide a direct current output voltage as a DC output.

3. The system of claim 2, wherein the safety control apparatus is configured to operate the switching device based on a comparison of the DC output to a predetermined value of a threshold voltage limit.

4. The system of claim 1, wherein operation of the switching device to controllably connect and disconnect the motor power cable to and from, respectively, the one or more motor loads comprises providing a pulse-width-modulated signal generated by the controller to an input of the switching device.

5. The system of claim 4, wherein a width of a pulse of the pulse-width-modulated signal is determined by a time period when a sensed voltage level that is present on the set of electrical conductors of the motor power cable is at or above a maximum threshold voltage level.

6. The system of claim 1, wherein the one or more motor loads comprise an electrical resistor.

7. The system of claim 1, wherein the one or more motor loads comprise an electrical energy storage device.

8. The system of claim 1, wherein the switching device comprises an insulated-gate bipolar transistor.

9. The system of claim 1, wherein the safety control apparatus is configured to limit a speed of rotation of the motor using the one or more motor loads.

10. The system of claim 1, wherein the threshold voltage level is 50 volts.

11. A method comprising:

electrically coupling a safety control apparatus to a set of electrical conductors of a motor power cable that are coupled to a motor of an electrical submersible pump apparatus, the electrical submersible pump apparatus configured to be positioned within a wellbore and configured to be operated by the motor in order to provide an artificial lift of formation fluids from within the wellbore;

monitoring, by the safety control apparatus, a voltage level that is present on the set of electrical conductors of the motor power cable; and controllably connecting and disconnecting, using at least one switching device, the set of electrical conductors of the motor power cable to and from, respectively, a motor load configured to limit the voltage level that is present on the set of electrical conductors to a predetermined threshold voltage level based on the monitoring of the voltage level present on the set of electrical conductors of the motor power cable when the motor is not being electrically powered to operate the submersible pump and when the motor is being mechanically rotated by a flow of fluid passing through the submersible pump.

12. The method of claim 11, wherein the monitoring of the voltage level on the set of electrical conductors of the motor power cable comprises rectifying voltages present on the set of electrical conductors to provide a direct current (DC) output voltage, and monitoring a level of the DC output voltage.

13. The method of claim 11, wherein controllably connecting and disconnecting the set of electrical conductors of the motor power cable to and from, respectively, the motor load comprises providing a pulse-width-modulated signal to an input of the at least one switching device.

14. The method of claim 11, further comprising controllably connecting and disconnecting the set of electrical conductors of the motor power cable to and from, respectively, the motor load to limit a speed of rotation of the motor.

15. The method of claim 11, wherein the predetermined threshold voltage level is 50 volts.

16. The method of claim 11, wherein a connection between the set of electrical conductors of the motor power cable and the motor load is made based on a determination that the voltage level present on the set of electrical conductors of the motor power cable has reached the predetermined threshold voltage level, and a disconnection of the set of electrical conductors of the motor power cable from the motor load is made based on a determination that the voltage level present on the set of electrical conductors of the motor power cable is below the predetermined threshold voltage level.

17. The method of claim 11, wherein electrically coupling the safety control apparatus to the set of electrical conductors of the motor power cable further comprises:

monitoring an electrical line source that is coupled to the set of electrical conductors of a motor power cable to determine that the electrical line source is providing electrical power to the set of electrical conductors of the motor power cable; and automatically, using a disconnect switch, disconnecting the set of electrical conductors of the motor power cable from the electrical line source and connecting the set of electrical conductors of the motor power cable to the safety control apparatus.

18. A non-transitory, computer-readable medium having instructions stored thereon that are executable by a processor to perform operations comprising:

monitoring, using one or more output signals received from one or more sensors, a voltage level that is present on a set of electrical conductors of a motor power cable coupled to a motor of an electrical submersible pump assembly; and providing an output signal to controllably connect and disconnect, using at least one switching device, the set of electrical conductors of the motor power cable to and from, respectively, a motor load configured to limit the voltage level present on the set of electrical conductors to a predetermined threshold voltage level based on the monitoring of the voltage level present on the set of electrical conductors when the motor is not being electrically powered to operate the submersible pump and when the motor is being mechanically rotated by a flow of fluid passing through the submersible pump.

19. The non-transitory, computer readable medium of claim 18, wherein monitoring the voltage level present on the set of electrical conductors of the motor power cable comprises rectifying voltages present on the set of electrical conductors to provide a direct current (DC) output voltage, and monitoring a level of the DC output voltage.

20. The non-transitory, computer readable medium of claim 18, wherein the operations further comprise controllably connecting and disconnecting the set of electrical conductors of the motor power cable to and from, respectively, the motor load to limit a speed of rotation of the motor.

* * * * *